US012716611B2

(12) United States Patent
Yun

(10) Patent No.: US 12,716,611 B2
(45) Date of Patent: Aug. 25, 2026

(54) AIR CONDITIONER

(71) Applicant: LG ELECTRONICS INC., Seoul (KR)

(72) Inventor: Hyeongnam Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 598 days.

(21) Appl. No.: 18/195,026

(22) Filed: May 9, 2023

(65) Prior Publication Data

US 2023/0366586 A1 Nov. 16, 2023

(30) Foreign Application Priority Data

May 10, 2022 (KR) ..... 10-2022-0057307

(51) Int. Cl.
*F24F 13/14* (2006.01)

(52) U.S. Cl.
CPC ..... *F24F 13/14* (2013.01)

(58) Field of Classification Search
CPC ..... F24F 13/14; F24F 1/0047; F24F 1/0011; F24F 1/0014; F24F 1/0018; F24F 1/0073; F24F 1/0025; F24F 11/74; F24F 11/79; F24F 13/085; F24F 13/1426; F24F 13/15; F24F 13/20; F24F 13/082; F24F 13/1413; F24F 2013/1433; F24F 2013/1446; F24F 2013/1473; F24F 2221/14
USPC ..... 454/322
See application file for complete search history.

(56) References Cited

U.S. PATENT DOCUMENTS

| | | | | |
|---|---|---|---|---|
| 5,873,780 | A † | 2/1999 | Mori | |
| 5,943,872 | A | 8/1999 | Sakurada et al. | |
| 6,083,101 | A * | 7/2000 | Kaga | F24F 1/0057 165/122 |
| 2006/0053824 | A1 * | 3/2006 | Jung | F24F 1/0057 62/419 |

(Continued)

FOREIGN PATENT DOCUMENTS

| | | |
|---|---|---|
| CN | 103946639 | 7/2014 |
| CN | 104949198 | 9/2015 |
| CN | 206504452 | 9/2017 |

(Continued)

OTHER PUBLICATIONS

International Search Report issued in Application No. PCT/KR2023/006266 dated Aug. 29, 2023.

(Continued)

*Primary Examiner* — Steven B Mcallister
*Assistant Examiner* — Charles R Brawner
(74) *Attorney, Agent, or Firm* — KED & ASSOCIATES

(57) ABSTRACT

An air conditioner is provided that may include a cabinet in which a suction port and a discharge port are respectively formed; a fan that is disposed inside of the cabinet and blows air from the suction port to the discharge port; a heat exchanger that is disposed inside of the cabinet and exchanges heat with flowing air; and a vane module having at least one horizontal vane that is rotated in a direction perpendicular to the discharge port and guides air flowing through the discharge port, and at least one vertical vane that is rotated in a direction horizontal to the discharge port and guides air flowing through the discharge port.

17 Claims, 21 Drawing Sheets

(56) References Cited

U.S. PATENT DOCUMENTS

2020/0191420 A1* 6/2020 Lee ..... F24F 1/0047

FOREIGN PATENT DOCUMENTS

| | | | |
|---|---|---|---|
| CN | 109764408 | | 5/2019 |
| CN | 111295553 | | 6/2020 |
| EP | 2327938 | A1 † | 6/2011 |
| EP | 2 557 367 | | 2/2013 |
| JP | 2001-208415 | | 8/2001 |
| JP | 2006275391 | A † | 10/2006 |
| JP | 2013-117356 | | 6/2013 |
| JP | 2014-145499 | | 8/2014 |
| JP | 6429204 | | 11/2018 |
| KR | 10-2008-0062889 | | 7/2008 |
| KR | 10-1195563 | | 10/2012 |
| KR | 10-1212691 | | 12/2012 |
| KR | 10-2019-0027338 | | 3/2019 |
| KR | 20190086251 | A † | 7/2019 |

OTHER PUBLICATIONS

European Search Report issued in Application No. 23172367.7 dated Oct. 5, 2023.
Chinese Office Action issued in Application No. 202310521151.0 dated Dec. 18, 2025.

* cited by examiner
† cited by third party

AIR CONDITIONER

CROSS-REFERENCE TO RELATED APPLICATION(S)

This application claims priority under 35 U.S.C. § 119 to Korean Application No. 10-2022-0057307, filed in Korea on May 10, 2022, whose entire disclosure is hereby incorporated by reference.

BACKGROUND

1. Field

An air conditioner, and more particularly, an air conditioner including a vane module that is easily detachable while having heterogeneous discharge vanes orthogonal to each other is disclosed herein.

2. Background

An air conditioner is a device used to control and circulate air for indoor heating, cooling, and dehumidification, for example. The air conditioner includes an indoor unit that conditions indoor air, an outdoor unit that discharges hot or cold air received by the indoor air to outside, a compressor that discharges and circulates refrigerant at high temperature and high pressure, and a vane that adjusts a wind direction generally provided in an air discharge port of the indoor unit.

A related art air conditioner disclosed in Korean Patent Registration No. 10-1195563 (Oct. 30, 2012), which is hereby incorporated by reference, includes a single vane that rotates in a direction (upward-downward direction) perpendicular to a discharge port and guides a blowing direction, so that the wind direction of the discharged air may be controlled. However, as the related art air conditioner does not have a means for guiding the blowing direction in a horizontal or lateral direction (leftward-rightward direction) to the discharge port, there is a limitation in that the wind direction of the discharged air cannot be adjusted in the leftward-rightward direction.

In addition, as the related air conditioner has only a single vane that rotates in the upward-downward direction, there is a limitation in that the wind direction of discharged air cannot be more accurately adjusted even in the upward-downward direction. Further, if a plurality of vanes is provided in a single discharge port in order to more precisely control the wind direction of the discharged air, the structure of the discharge port becomes complicated, which essentially requires periodic cleaning. Accordingly, there is a problem in that management convenience for a user is reduced.

It is known that a discharge air volume of an air conditioner, which is one of the factors determining air conditioning performance of the air conditioner, is affected by a fan performance of the air conditioner, an air flow path, a shape of a vane, and a shape of a discharge port, for example. However, in a related art ceiling-type air conditioner disclosed in Korean Patent Registration No. 10-1212691 (Dec. 14, 2012), which is hereby incorporated by reference, there is a limit in that a length of the discharge port is limited to a length similar to that of a portion accommodated in the ceiling of a housing, and the air flow rate of the air conditioner is limited.

BRIEF DESCRIPTION OF THE DRAWINGS

Embodiments will be described in detail with reference to the following drawings in which like reference numerals refer to like elements wherein.

DETAILED DESCRIPTION

Figure 1:
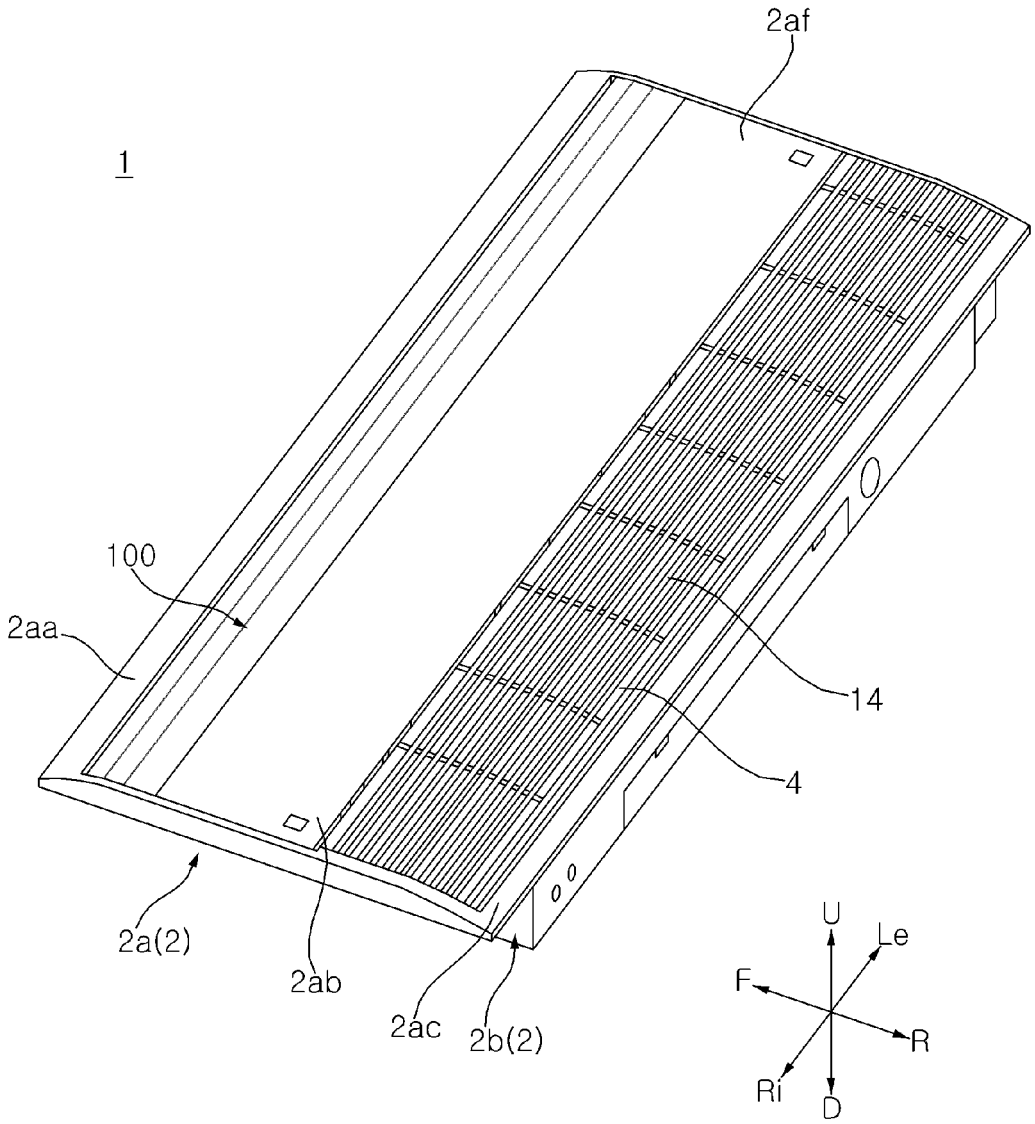
FIG. 1 is a perspective view of an air conditioner according to an embodiment.

Exemplary embodiments are described with reference to the accompanying drawings. The same or like reference numbers are used throughout the drawings to refer to the same or like parts. Descriptions of well-known functions and structures incorporated herein may be omitted to avoid obscuring the subject matter.

Hereinafter, it should be understood that terms "comprises, includes," "has," etc. specify the presence of features, numbers, steps, operations, elements, components, or combinations thereof described in the specification, but do not preclude the presence or addition of one or more other features, numbers, steps, operations, elements, components, or combinations thereof.

In addition, hereinafter, terms such as first and second may be used to describe various elements, but these elements are not limited by these terms. These terms may only be used to distinguish one element from another.

In the following description, the description of direction may follow the orientation of drawing. In the drawing, 'F' denotes 'front', 'R' denotes 'rear', 'Ri' denotes 'right', 'Le' denotes 'left', 'U' denotes 'up', and 'D' denotes 'down'. Hereinafter, for convenience, an air conditioner 1 may be described using the orientation of drawing, but the orientation is introduced only for convenience of description, and the gist of the technical concept is not limited by the orientation itself.

Hereinafter, when two components are 'integrally connected', it may mean that the two components are connected so as not to perform relative motion. Hereinafter, for example, it is obvious that '102' includes '102*a*' and '102*b*'.

Figure 2:
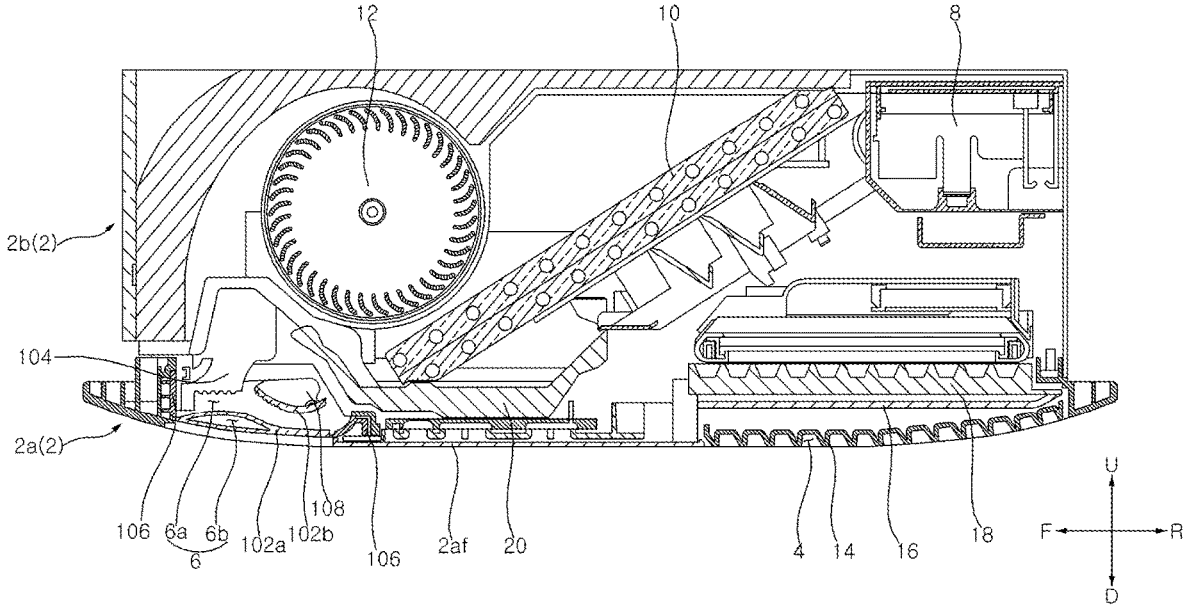
FIG. 2 is a side cross-sectional view of an air conditioner according to an embodiment.
Figure 3:
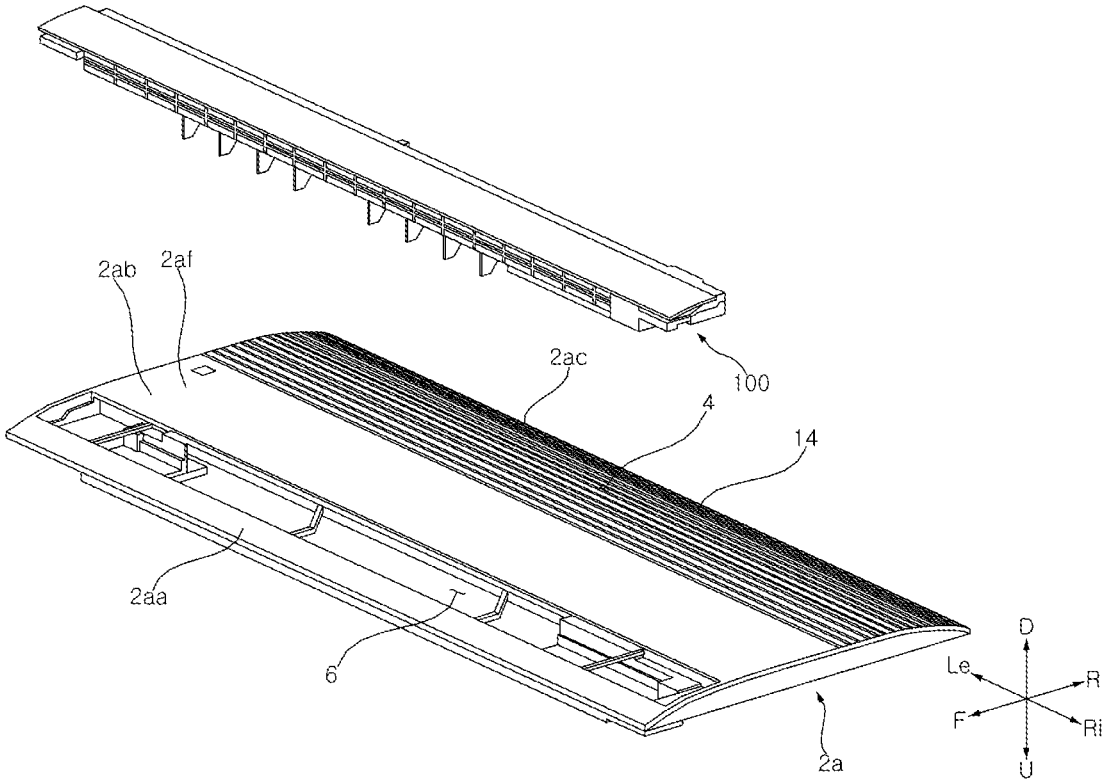
FIG. 3 is an exploded perspective view of a vane module and a low cabinet of an air conditioner according to an embodiment.
Figure 4:
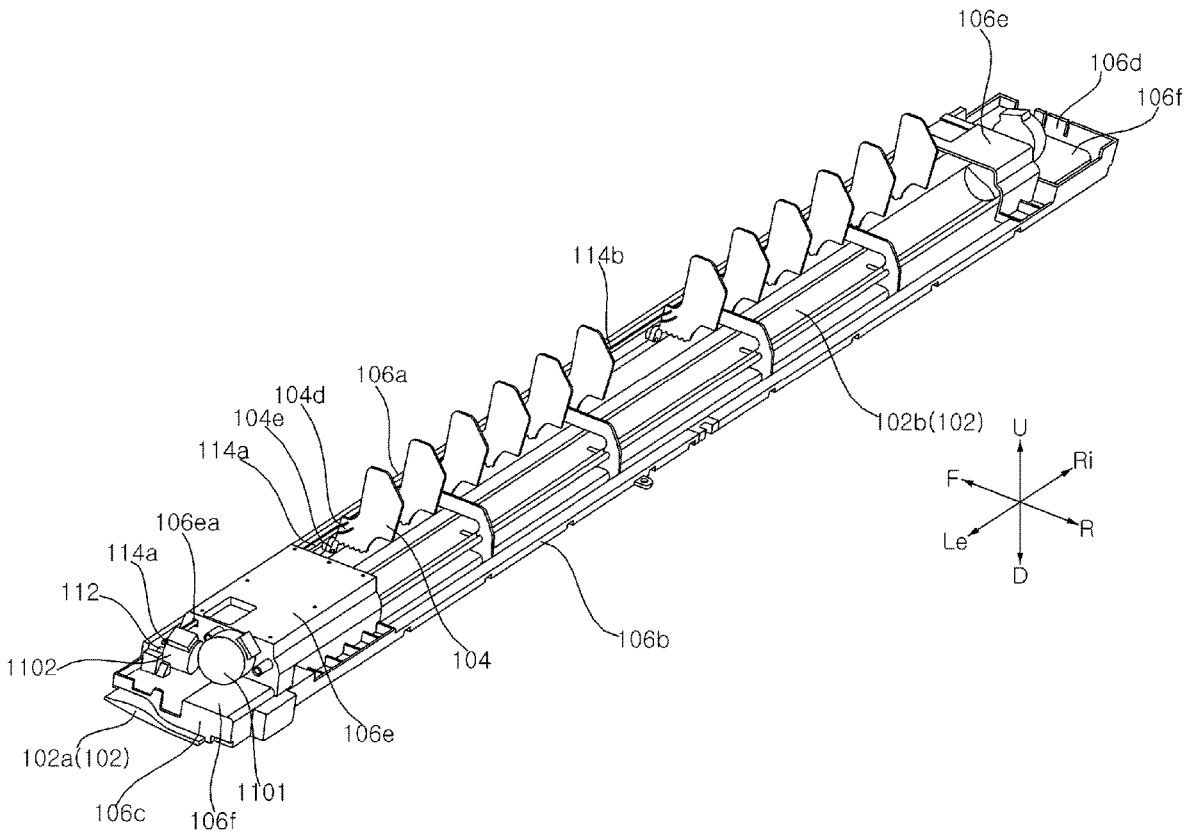
FIG. 4 is a top perspective view of a vane module of an air conditioner according to an embodiment.
Figure 5:
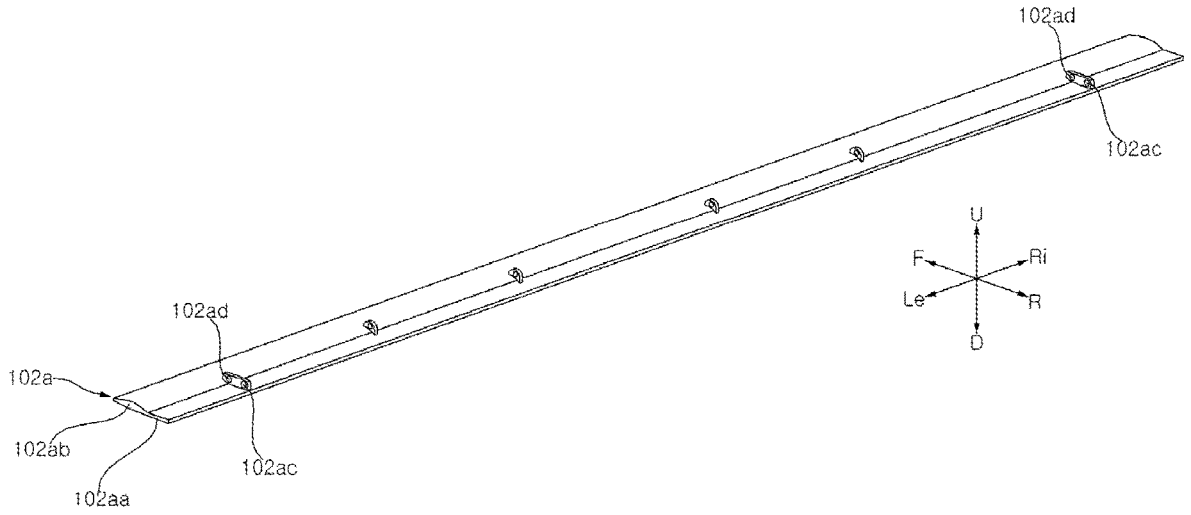
FIG. 5 is a perspective view of a first vane of an air conditioner according to an embodiment.
Figure 6:
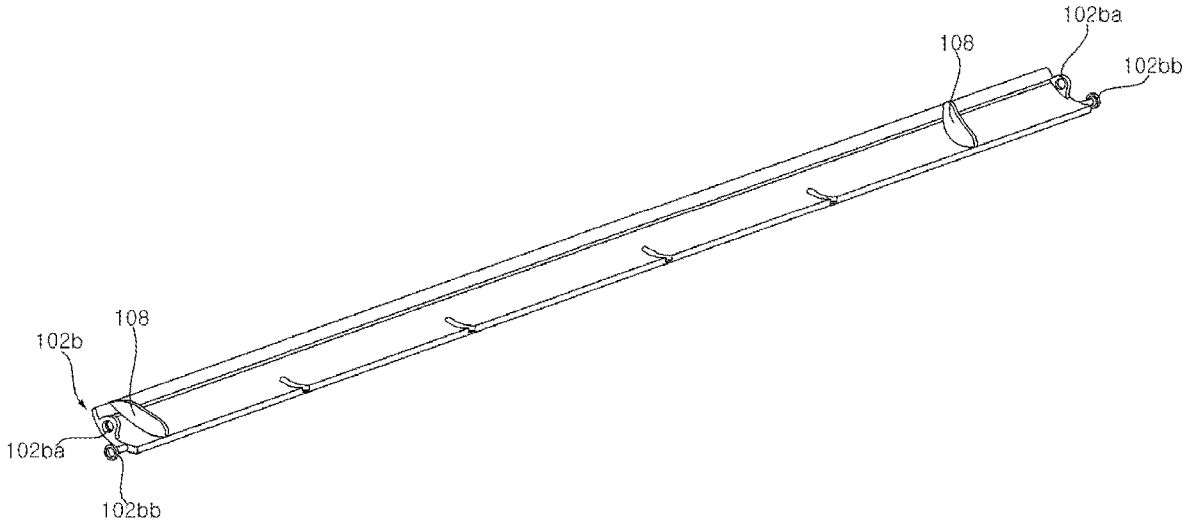
FIG. 6 is a perspective view of a second vane of an air conditioner according to an embodiment.

Referring to FIGS. 1 to 3, an overall configuration of an air conditioner 1 according to an embodiment will be described.

In a cabinet 2, a suction port 4 and a discharge port 6 are formed. The cabinet 2 may form an outer shape of the air conditioner 1. The cabinet 2 may form an inner space of the air conditioner 1.

The cabinet 2 may include a lower cabinet 2*a* and an upper cabinet 2*b*. The upper cabinet 2*b* may form an internal space and have one open surface. The upper cabinet 2*b* may be in the form of a hollow box with an open lower surface. The upper cabinet 2*b* may be accommodated in a ceiling space.

The lower cabinet 2*a* may cover the open one surface of the upper cabinet 2*b*. The lower cabinet 2*a* may cover the open lower surface of the upper cabinet 2*b*. The lower cabinet 2*a* may be fastened to the upper cabinet 2*b*. The lower cabinet 2*a* may be exposed to an indoor space. The lower cabinet 2*a* may have a plate shape wider than the open lower surface of the upper cabinet 2*b*. The lower cabinet 2*a* may have a long side in the leftward-rightward direction, a short side in the frontward-rearward direction, and a thickness in the upward-downward direction.

A part or portion of the lower cabinet 2*a* may be open to form the suction port 4 and the discharge port 6. The suction port 4 and/or the discharge port 6 may be formed elongated along a long side of the lower cabinet 2*a* in the leftward-rightward direction, respectively. The suction port 4 and/or the discharge port 6 may be formed at portions spaced apart from each other in the lower cabinet 2*a*, respectively. The suction port 4 may be formed adjacent to a rear end of the lower cabinet 2*a*. The discharge port 6 may be formed adjacent to a front end of the lower cabinet 2*a*.

When viewed from a lower side, the lower cabinet 2*a* may be divided into a rear portion 2*ac*, a middle portion 2*ab*, and a front portion 2*aa* by the suction port 4 and the discharge port 6. The rear portion 2*ac* of the lower cabinet 2*a* may refer to an area ranging from a rear end of the suction port 4 to a rear end of the lower cabinet 2*a*. The middle portion 2*ab* of the lower cabinet 2*a* may refer to an area ranging from a rear end of the discharge port 6 to a front end of the suction port 4. The front portion 2*aa* of the lower cabinet 2*a* may refer to an area ranging from a front end of the lower cabinet 2*a* to a front end of the discharge port 6.

A lower surface of the middle portion 2*ab* of the lower cabinet 2*a* may be covered by a deco panel 2*af*. The decor panel 2*af* may be formed to have a width corresponding to the lower surface of the middle portion 2*ab*. The decor panel 2*af* may be detachably fastened to the lower surface of the middle portion 2*ab* of the lower cabinet 2*a*.

Figure 19:
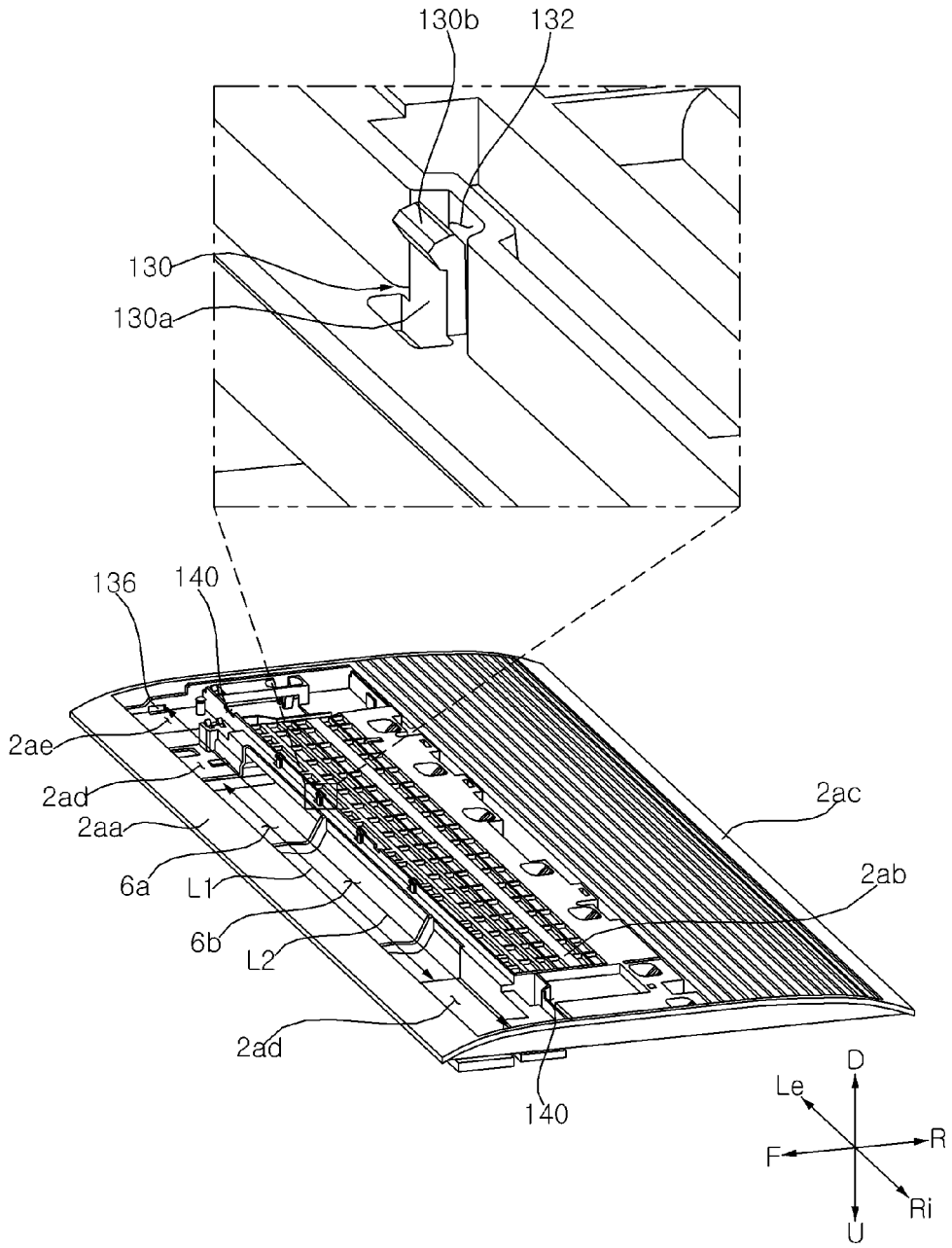
FIG. 19 is an enlarged perspective view of a second hook of a low cabinet of an air conditioner according to an embodiment.
Figure 21:
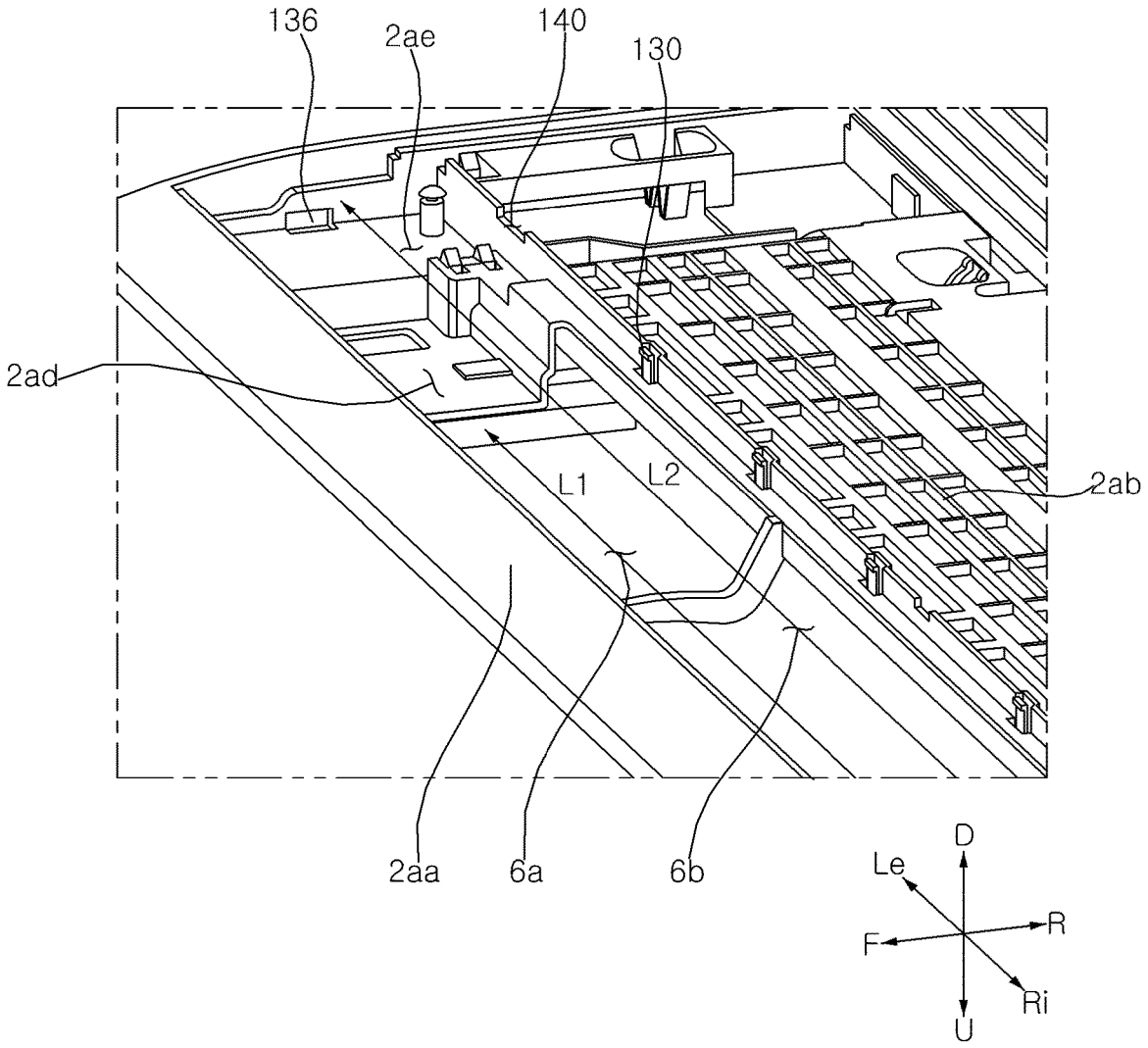
FIG. 21 is a partial perspective view of a low cabinet of an air conditioner according to an embodiment.

The discharge port 6 may be divided into a first discharge port 6*a*, which is an upstream portion, and a second discharge port 6*b*, which is a downstream portion, based on an air flow direction when fan 12 operates (see FIGS. 19 and 21). The first discharge port 6*a* may face the open one surface of the upper cabinet 2*b*. The second discharge port 6*b* may face with an indoor space in which the air conditioner 1 is installed.

A length of an upstream portion of the first discharge port 6*a* may be the same as a length of the open one surface of the upper cabinet 2*b*. That is, a length L1 of the upstream portion of the first discharge port 6*a* in the leftward-rightward direction may be the same as the length of the open one surface of the upper cabinet 2*b* in the leftward-rightward direction. Accordingly, a portion adjacent to the discharge port 6 in the inner space of the upper cabinet 2*b* may be continuously formed up to the upstream portion of the first discharge port 6*a* while maintaining the length in the leftward-rightward direction.

A downstream portion of the first discharge port 6*a* has a seating space 2*ad* for a cover plate 106*e* or a seating space 2*ae* for a mounting portion 106*f* formed in both ends in the leftward-rightward direction, so that the length may be longer than the length L1 of the upstream portion of the first discharge port 6*a*. The seating space 2*ad* of the cover plate 106*e* or the seating space 2*ae* of the mounting portion 106*f* may be formed in a shape corresponding to the mounting portion 106*f* and the cover plate 106*e* of a housing 106 of a vane module 100 such that the mounting portion 106*f* and the cover plate 106*e* of the housing 106 of the vane module 100 may be seated therein. The seating space 2*ad* of the cover plate 106*e* or the seating space 2*ae* of the mounting portion 106*f* may be formed by extending a portion forming the discharge port 6 of the lower cabinet 2*a* into the discharge port 6 in the form of a flat plate.

The second discharge port 6*b* may be formed to be wider than the first discharge port 6*a* in a certain or predetermined direction. The certain or predetermined direction may be a direction in which the lower cabinet 2*a* is wider than the open lower surface of the upper cabinet 2*b*. When the lower cabinet 2*a* is wider than the open lower surface of the upper cabinet 2*b* in the leftward-rightward direction, the second discharge port 6*b* may be formed to be wider than the first discharge port 6*a* in contact with the open lower surface of the upper cabinet 2*b* in the leftward-rightward direction. That is, a length L2 of the second discharge port 6*b* in the leftward-rightward direction may be longer than the length of the first discharge port 6*a* in the leftward-rightward direction. The length L2 of the second discharge port 6*b* in the leftward-rightward direction may be the same as the length of the lower cabinet 2*a* in the leftward-rightward direction. Accordingly, it is possible to secure the discharge port 6 having a larger area compared to a volume of the upper cabinet 2*b*, thereby improving blowing performance of the air conditioner 1.

The fan 12 may be disposed inside of the cabinet 2 and blow air from the suction port 4 to the discharge port 6. The fan 12 may be accommodated inside of the upper cabinet 2*b*. The fan 12 may be a cross-flow fan 12 having a length corresponding to lengths of the suction port 4 and the discharge port 6 in the leftward-rightward direction. The fan 12 may be disposed parallel to the suction port 4 and the discharge port 6.

The heat exchanger 10 may be disposed inside of the cabinet 2 and exchange heat with flowing air. The heat exchanger 10 may be accommodated inside of the upper cabinet 2*b*. The heat exchanger 10 may heat-exchange air flowing from the suction port 4 to the discharge port 6. The heat exchanger 10 may be disposed obliquely so that condensed water on a surface thereof is collected in a water collector 20 described hereinafter.

The water collector 20 may be disposed below the heat exchanger 10. The water collector 20 may be supported from a lower side by the lower cabinet 2*a*. The water collector 20 may be in the form of a bowl with a dent in a center so that condensed water is accumulated therein. The water collector 20 may allow condensed water formed on the surface of the heat exchanger 10 to fall downward due to gravity or to flow down along the surface of the heat exchanger 10 so that the water is accumulated therein. The water collector 20 may be connected to a separate drain pipe (not shown) and drain pump (not shown) to drain accumulated condensed water to the outside.

A control box 8 may be accommodated inside of the upper cabinet 2*b*. The control box 8 may form a separate inner space and a controller may be accommodated therein. The controller (not shown) may be electrically connected to components, such as a motor 110 and fan 12 to supply electricity thereto, and transmit electrical signals to control the components. The controller may receive a control signal transmitted by an external user.

A grill 14 may be disposed in the suction port 4 to prevent foreign substances from being suctioned into the air conditioner 1. The grill 14 may have a shape in which a plurality of blades is spaced apart from each other. A first filter 16 and a second filter 18 may be disposed in the suction port 4 to purify the suctioned air. The first filter 16 and the second filter 18 may be filters of different types that perform different functions. For example, the first filter 16 may be a dust collecting filter using static electricity. For example, the second filter 18 may be a deodorizing filter.

The grill 14, the first filter 16, and the second filter 18 may be formed to have a width corresponding to a width of the suction port 4. The grill 14, the first filter 16, and the second filter 18 may be sequentially disposed in the air flow direction in the suction port 4. For example, the grill 14 may be disposed upstream of the suction port 4, the first filter 16 may be disposed downstream of the grill 14, and the second filter 18 may be disposed downstream of the first filter 16. The air suctioned into the air conditioner 1 may be purified while sequentially passing through the grill 14, the first filter 16, and the second filter 18.

Figure 7:
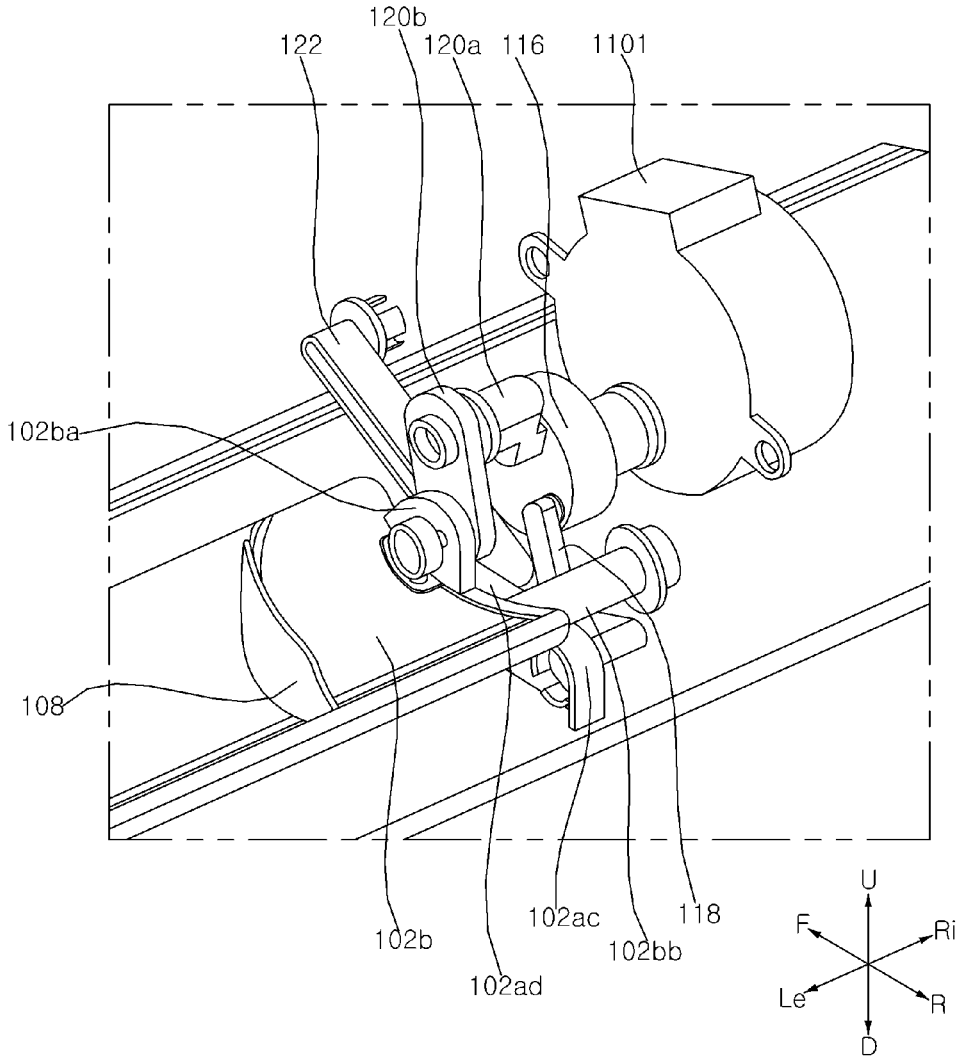
FIG. 7 is a perspective view of a connection portion between a first motor and first and second vanes of an air conditioner according to an embodiment.
Figure 8:
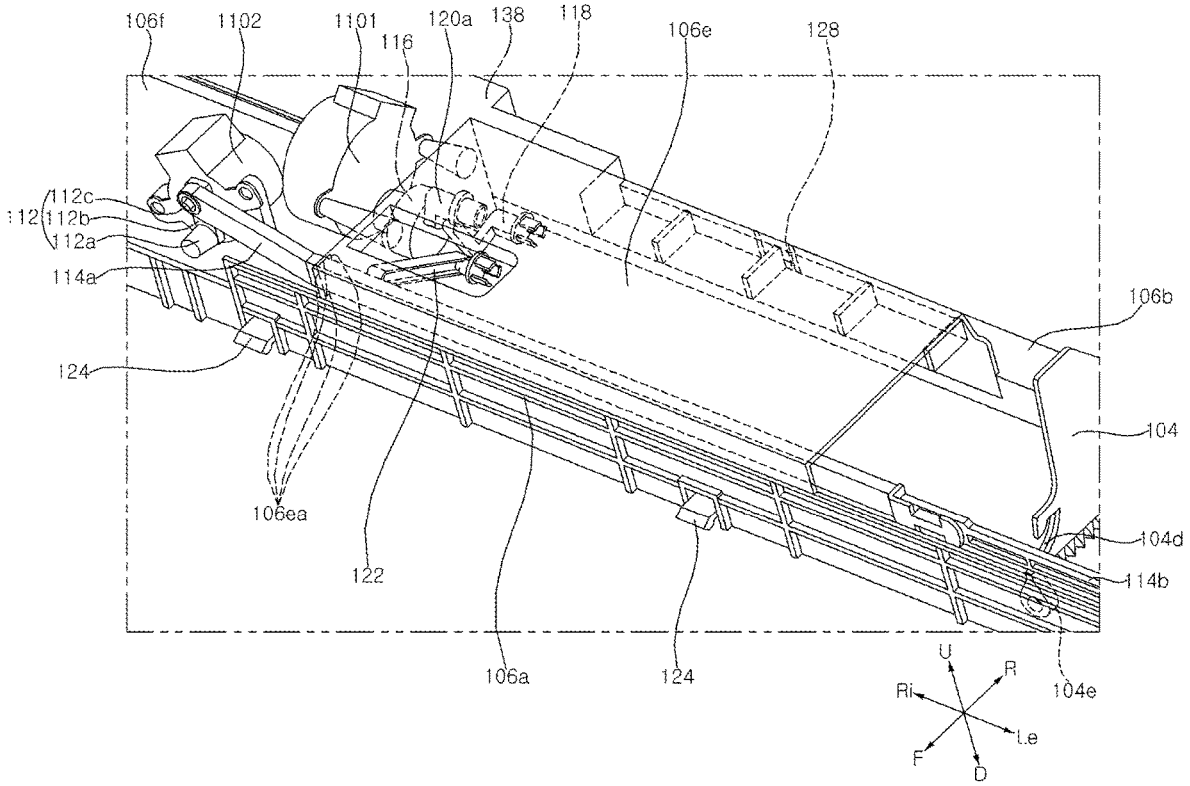
FIG. 8 is a transparent perspective view illustrating a connection portion between a motor and a vane of an air conditioner according to an embodiment.
Figure 9:
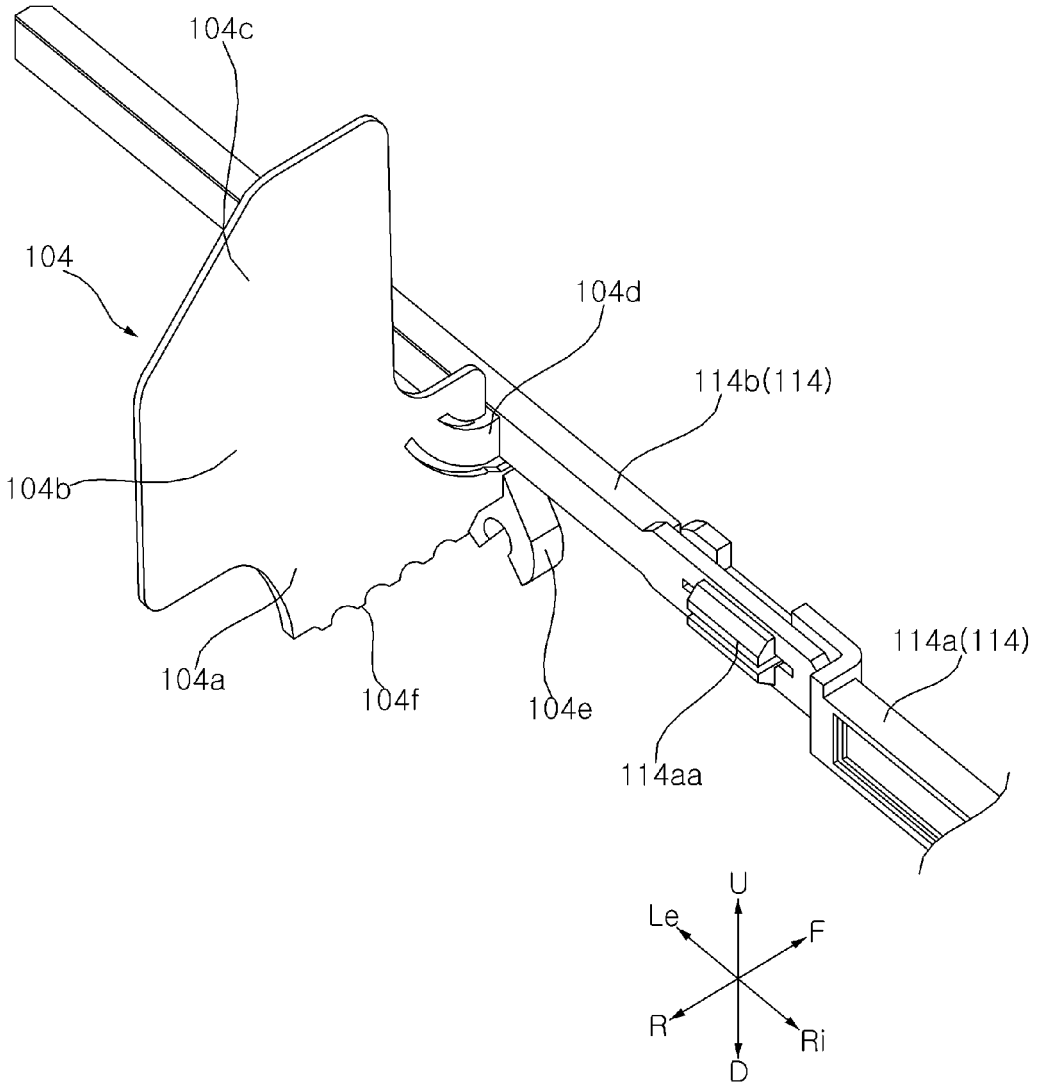
FIG. 9 is a perspective view of a third vane of an air conditioner according to an embodiment.
Figure 10:
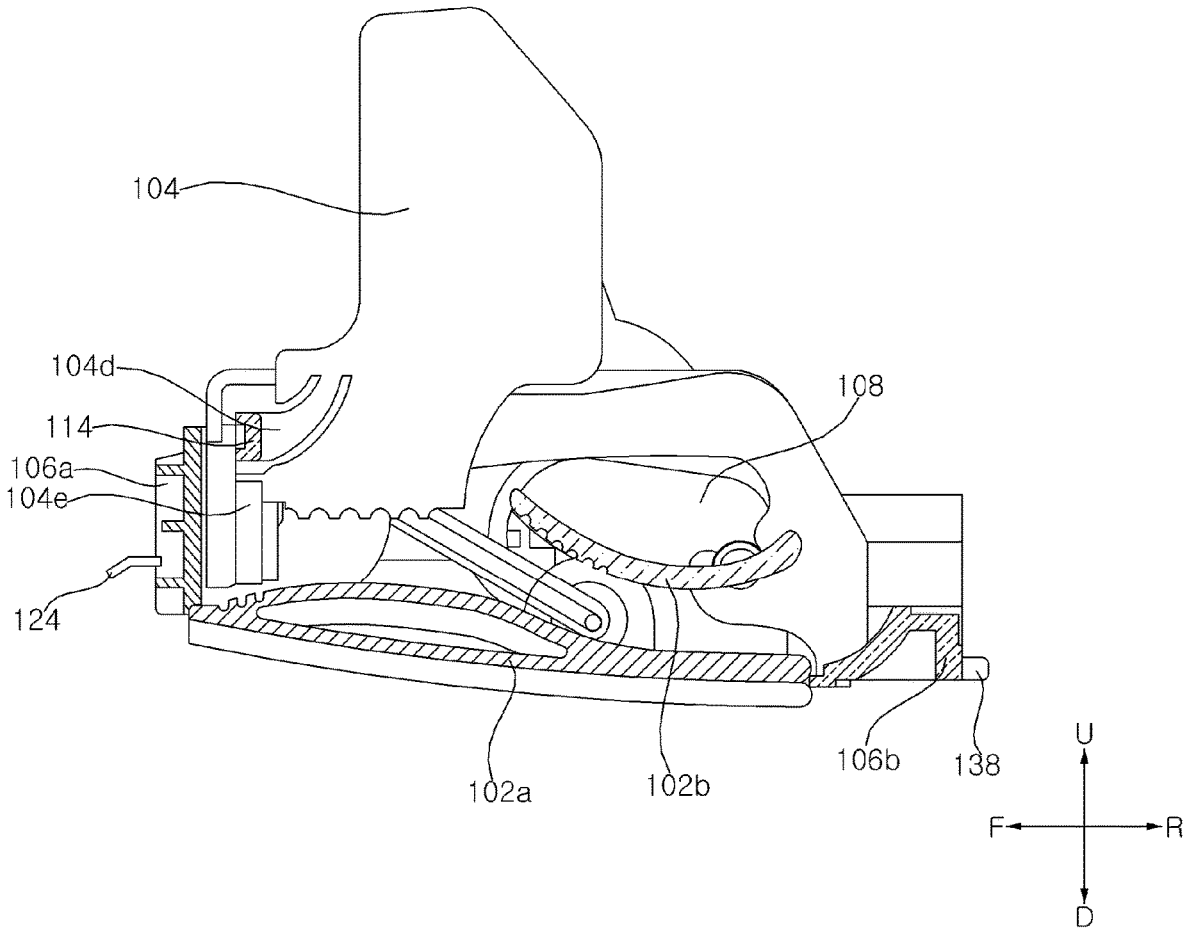
FIG. 10 is a side cross-sectional view of a vane module of an air conditioner according to an embodiment.

Hereinafter, a vane module of an air conditioner according to an embodiment will be described with reference to FIGS. 4 to 10. FIG. 7 is a perspective view of a connection portion between a first motor and first and second vanes of a vane module in which a housing and a cover plate are disassembled. FIG. 8 is a partially transparent perspective view of a vane module in which a vane is disassembled.

The vane module 100 may be disposed in the discharge port 6. The vane module 100 may have a shape corresponding to the discharge port 6. The vane module 100 may include at least one vane that guides a wind direction of discharged air. The vane may be divided into a horizontal vane 102 and a vertical vane 104 according to a shape and rotational direction. The vane module 100 may include motor 110 that provides a drive force to the vanes. The vane module 100 may include a connection portion that transmits the drive force of the motor 110 to the vane. The vane module 100 may include housing 106 forming at least a part or portion of an outer shape of the vane module 100.

The housing 106 may form an outer circumference of the vane module 100. The housing 106 may accommodate the motor 110, the vane, and a connection portion between the motor 110 and the vane. The housing 106 may include a front housing 106*a* forming a front surface of an outer circumference of the vane module 100, a rear housing 106*b* forming a rear surface of the outer circumference of the vane module 100, a left side surface housing 106*c* forming a left side surface of the outer circumference of the vane module 100, and a right side surface housing 106*d* forming a right side surface of the outer circumference of the vane module 100.

The housing 106 may include motor 110 at both end portions in the leftward-rightward direction, and a mounting portion 106*f* that accommodates the connection portion between the motor 110 and the vane. The mounting portion 106*f* may be in the form of a flat plate that extends inwardly from the outer circumference of the vane module 100. On an upper side of the mounting portion 106*f*, the motor 110 and the connection portion between the motor 110 and the vane may be seated. The vane may be disposed between the mounting portions 106*f* at both end portions of the vane module 100. The vane may be connected to at least one motor 110 disposed in the mounting portions 106*f* at both end portions of the vane module 100 and rotated.

The vane module 100 may include cover plate 106*e* that covers the connection portion between the motor 110 and the vane. The cover plate 106*e* may extend from the housing 106 and cover the connection portion to prevent air from flowing into the connection portion.

The vane module 100 may include a horizontal vane that rotates in a vertical direction with respect to the discharge port 6 and guides air flowing through the discharge port 6. The rotation in the vertical direction with respect to the discharge port 6 may mean, for example, rotation in the upward-downward direction based on a rotational axis formed in the leftward-rightward direction, if the discharge port has a shape having a length in the leftward-rightward direction, a width in the frontward-rearward direction, and a depth in the upward-downward direction.

The horizontal vane 102 may be a plate-shaped vane disposed in a horizontal direction with respect to the discharge port 6. When viewed from the lower side, the horizontal vane 102 may be a plate-shaped vane having a width corresponding to the shape of the discharge port 6. The horizontal vane 102 may be a plate-shaped vane having a long side (or length) in the leftward-rightward direction, a short side (or width) in the frontward-rearward direction, and a thickness in the upward-downward direction.

The horizontal vane 102 may include a first vane 102*a* disposed in the lower end of the discharge port 6 and a second vane 102*b* disposed upstream of the first vane 102*a*. The first vane 102*a* may be disposed in the second discharge port 6*b* which is a downstream portion of the discharge port 6. The first vane 102*a* may have a shape corresponding to the second discharge port 6*b*. The first vane 102*a* may be rotated to guide air flowing through the discharge port 6. The first vane 102*a* may be rotated to open and close the second discharge port 6*b*.

The first vane 102*a* may include a flat portion 102*aa* and a hill portion 102*ab*. The flat portion 102*aa* may be formed at a rear end side of the first vane 102*a*, and the hill portion 102*ab* may be formed at a front end side of the first vane 102*a*. The flat portion 102*aa* may have a substantially flat shape. The hill portion 102*ab* may have an upwardly convex shape when viewed from the side, as it has an inclined top surface. The flat portion 102*aa* and the hill portion 102*ab* may form a continuous surface. The first vane 102*a*, by having the hill portion 102*ab*, may enhance the blowing performance of the air conditioner 1 by improving a Coanda effect for discharged air.

A first-first fastening portion 102*ac* and a first-second fastening portion 102*ad* may be formed in a portion spaced inward by a certain or predetermined distance from both end portions of the first vane 102*a* in the longitudinal direction. The first-first fastening portion 102*ac* and the first-second fastening portion 102*ad* may respectively have a shape of a circularly open hole into which a circular hook is fastened. The first-first fastening portion 102*ac* and the first-second fastening portion 102*ad* may be formed in the same portion in the leftward-rightward direction on an upper surface of the first vane 102*a*. The first-first fastening portion 102*ac* and the first-second fastening portion 102*ad* may be formed in a line in the frontward-rearward direction. The first-first fastening portion 102*ac* may be formed adjacent to a rear end of the first vane 102*a* in the frontward-rearward direction, and the first-second fastening portion 102*ad* may be formed adjacent to a central portion of the first vane 102*a* in the frontward-rearward direction. The first-first fastening portion 102*ac* and the first-second fastening portion 102*ad* may be formed symmetrically in the leftward-rightward direction, and may be two respectively.

The second vane 102*b* may be disposed in the first discharge port 6*a*, which is an upstream portion of the discharge port 6. The second vane 102*b* may have a leftward-rightward length corresponding to the leftward-rightward length L1 of the first discharge port 6*a* (See FIG. 19). The second vane 102*b* may have a frontward-rearward width smaller than the frontward-rearward width of the first discharge port 6*a*. The second vane 102*b* may be disposed adjacent to the rear end of the first vane 102*a* on the upper side of the first vane 102*a*. The second vane 102*b* may be rotated to guide air flowing through the discharge port 6.

The second vane 102*b* may have a shape which is convexly rounded downward with a plate-shaped member. That is, the second vane 102*b* may be formed by being bent with a certain or predetermined curvature.

A second-first fastening portion 102*ba* and a second-second fastening portion 102*bb* may be formed in both end portions of the second vane 102*b* in a longitudinal direction. The second-first fastening portion 102*ba* may have a shape of a circularly open hole into which a circular hook is fastened. The second-second fastening portion 102*bb* may have a circular hook shape protruding from an end of the second vane 102*b* along the longitudinal direction of the second vane 102*b*. The second-second fastening portion 102*bb* may be rotatably fastened to the open hole formed in the leftward-rightward end of the cover plate 106*e*, and may serve as a rotational shaft of the second vane 102*b*.

The second-second fastening portion 102*bb* may be formed adjacent to a rear end of the second vane 102*b* in the frontward-rearward direction. The second-first fastening portion 102*ba* may be formed adjacent to a central portion of the second vane 102*b* in the frontward-rearward direction.

Therefore, due to a double vane rotating in a vertical direction with respect to the discharge port 6, it is possible to more precisely control the blowing direction compared to the case of a single vane.

Figure 15:
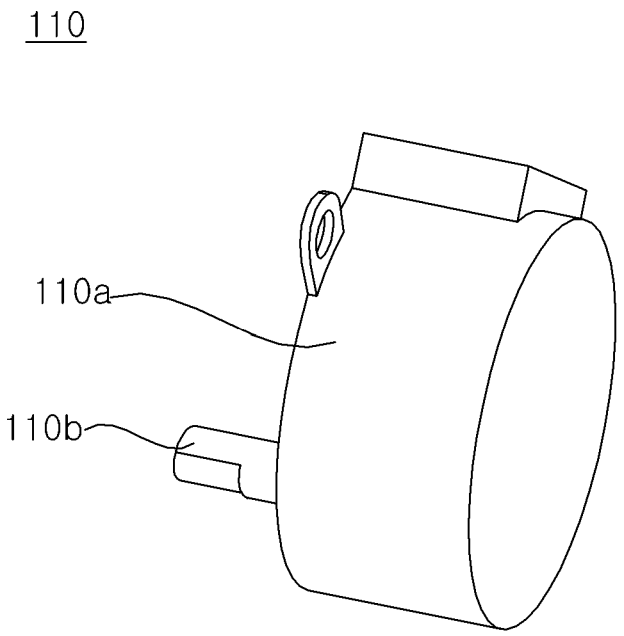
FIG. 15 is a perspective view of a vane motor of an air conditioner according to an embodiment.

The motor 110 may include a motor case 110*a* that accommodates a rotor (not shown) by forming an inner space, and a drive shaft 110*b* that protrudes in one direction from the motor case 110*a* and rotates according to operation of the motor 110. For example, the motor 110 may be a stepping motor generally used for the vane of an air conditioner (see FIG. 15).

The motor 110 connected to the horizontal vane 102 may be referred to as first motor 1101 for distinction from second motor 1102 connected to the vertical vane 104. In the first motor 1101, the drive shaft 110*b* may be disposed in a direction of the long side of the discharge port 6. That is, the first motor 1101 may be disposed such that the drive shaft 110*b* protrudes in the leftward-rightward direction.

The first motor 1101 may be seated on the mounting portion 106*f* of the housing 106. The motor case 110*a* of the first motor 1101 may be bolted to both left and right or lateral ends of the cover plate 106*e* to be fixed.

The connection portion between the first motor 1101 and the horizontal vane 102 may include a circular link. The circular link may include a link body 116 to which the drive shaft 110*b* of the first motor 1101 is connected, and a link leg that extends from the link body 116 and is connected to the vane.

The link body 116 may have a substantially cylindrical shape having a groove formed in one end so that the drive shaft 110*b* of the first motor 1101 is inserted therein. The link body 116 may have a cylindrical shape having a height in the leftward-rightward direction. One or a first end and the other or a second end of the link body 116 may refer to bottom and top surfaces of the cylinder. The drive shaft 110*b* of the first motor 1101 may be inserted into a central portion of one end of the link body 116.

The link leg may be a substantially 'L'-shaped member that protrudes from the other end of the link body 116 and is connected to the vane. The link leg may include a first link leg 118 that transmits the drive force of the first motor 1101 to the first vane 102*a* and a second link leg 120*a*, 120*b* that transmits the drive force of the first motor 1101 to the second vane 102*b*. Therefore, as a plurality of vanes may be driven by a single motor, noise and vibration caused by the motor may be reduced and economic efficiency of the air conditioner may be improved.

The link leg may protrude from a portion, among the other end of the link body 116, spaced a certain or predetermined distance from the drive shaft 110*b* of the first motor 1101 in a radially outward direction. The first link leg 118 and the second link leg 120*a*, 120*b* may be disposed at different angles based on a rotational axis defined by the drive shaft 110*b* of the first motor 1101.

The first link leg 118 extends in a radially outward direction by a certain or predetermined distance from the other end of the link body 116, then is bent vertically in a radial tangential direction to extend by a certain or predetermined distance, and then bent again vertically in the direction of a rotational axis of the drive shaft 110*b* of the first motor 1101 and extended by a certain or predetermined distance. A distal end of the first link leg 118 may be rotatably fastened to the first-first fastening portion 102*ac* of the first vane 102*a* by forming a circular hook.

The second link leg 120*a*, 120*b* may include a second-first link leg 120*a* and a second-second link leg 120*b*. The second-first link leg 120*a* may extend by a certain or predetermined distance radially outward from the other end of the link body 116, and then be bent vertically in the direction of the rotational axis of the drive shaft 110*b* of the first motor 1101 to extend by a certain or predetermined distance. A distal end of the second-first link leg 120*a* may be rotatably fastened to one or a first end of the second-second link leg 120*b*. The second-second link leg 120*b* may extend by a certain or predetermined distance in a radially inward direction from the one end to which the second-first link leg 120*a* is fastened. A distal end of the second-second link leg 120*b* may be rotatably fastened to the second-first fastening portion 102*ba* of the second vane 102*b* by forming a circular hook.

The connection portion between the first motor 1101 and the horizontal vane 102 may further include an auxiliary link 122. The auxiliary link 122 may assist rotational motion of the first vane 102*a*.

One or a first end of the auxiliary link 122 may be rotatably fastened to a leftward-rightward end portion of the cover plate 106*e* corresponding to a portion spaced forward by a certain or predetermined distance on a same plane as the other end of the link body 116. The auxiliary link 122 may extend rear-downward from one end. The other or a second end of the auxiliary link 122 may be rotatably fastened to the first-second fastening portion 102*ad* of the first vane 102*a*.

The one end and the other end of the auxiliary link 122 may be provided with a circular hook so as to be rotatably fastened to the leftward-rightward end portion of the cover plate 106*e* and the first-second fastening portions 102*ad* of the first vane 102*a* respectively.

The above-described connection portion between the first motor 1101 and the horizontal vane 102 may be provided symmetrically in both leftward-rightward end portion of the horizontal vane 102.

The cover plate 106*e* may extend from the housing 106 to cover the connection portion between the motor 110 and the vane. The cover plate 106*e* may cover the connection portion between the motor 110 and the vane from above, from the front, from the rear, and from one side. The motor 110 may be disposed adjacent to an outer end of the cover plate 106*e* in the leftward-rightward direction. At the leftward-rightward end of the cover plate 106*e*, a portion corresponding to a shape of the connection portion may be open so that the connection portion connected from the motor 110 to the vane may pass therethrough. In particular, a portion corresponding to a bar link 114 described hereinafter, among the leftward-rightward end of the cover plate 106*e*, may form a stopper portion 106*ea* described hereinafter. In addition, the leftward-rightward end of the cover plate 106*e* may be circularly open so that the one end of the auxiliary link 122 may be rotatably connected thereto.

Figure 11:
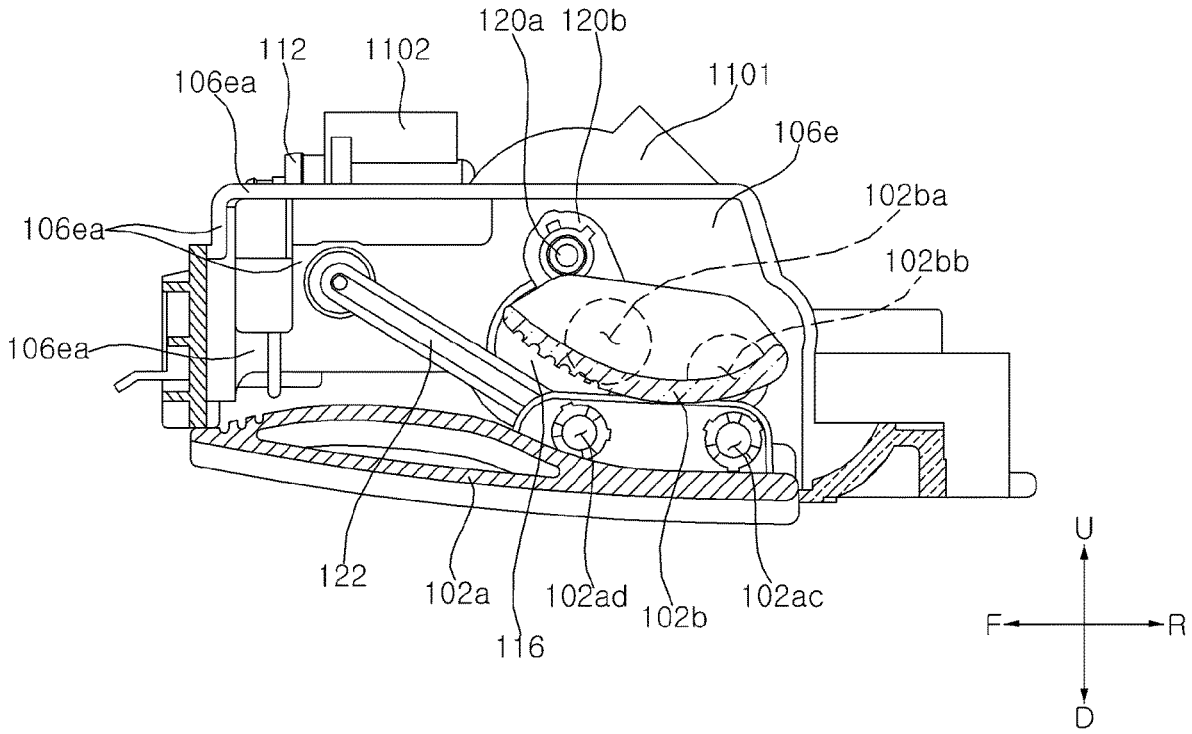
FIG. 11 is a cross-sectional side view of a vane module in a stopped state of an air conditioner according to an embodiment.

As the first vane 102*a* and the second vane 102*b* are formed, disposed, and fastened as described above, their disposition may be changed in the form shown in FIGS. 11 to 14 by operation of the first motor 1101. More specifically, as shown in FIG. 11, the first vane 102*a* closes the discharge port 6, and the second vane 102*b* may be disposed substantially horizontal to the discharge port 6. Accordingly, it is possible to prevent foreign substances from flowing into the air conditioner 1 while the air conditioner 1 is stopped.

Figure 12:
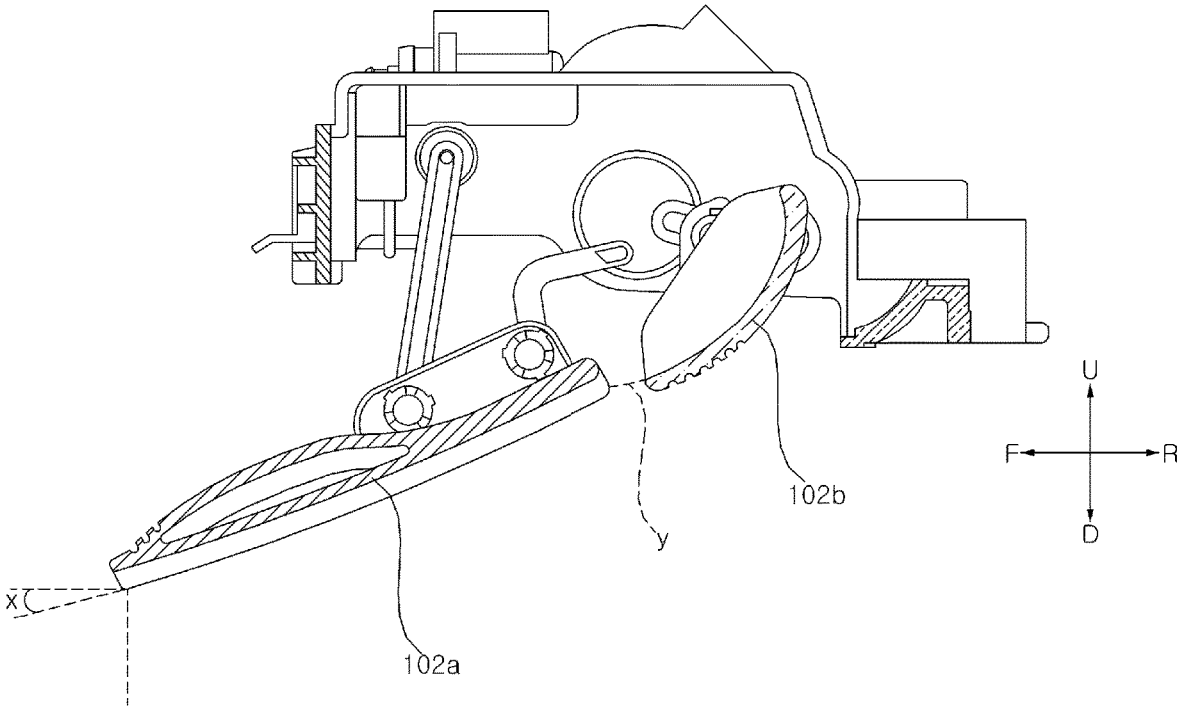
FIG. 12 is a cross-sectional side view of a vane module in a cooling mode of an air conditioner according to an embodiment.

In addition, as shown in FIG. 12, an angle x at which a front end of the first vane 102*a* descends downward from the front may be approximately 22 degrees. The front end of the first vane 102*a* may be maximally disposed forward than a front end of the vane module 100. The second vane 102*b* may be disposed so that a rear end of the first vane 102*a* is located on an extension line y of the front end of the second vane 102*b*. The air discharged through the discharge port 6 may be discharged a long distance forward along the first vane 102*a* and/or the second vane 102*b* by the Coanda effect. The disposition of the first vane 102*a* and the second vane 102*b* may be utilized in a cooling mode of the air conditioner 1.

Figure 13:
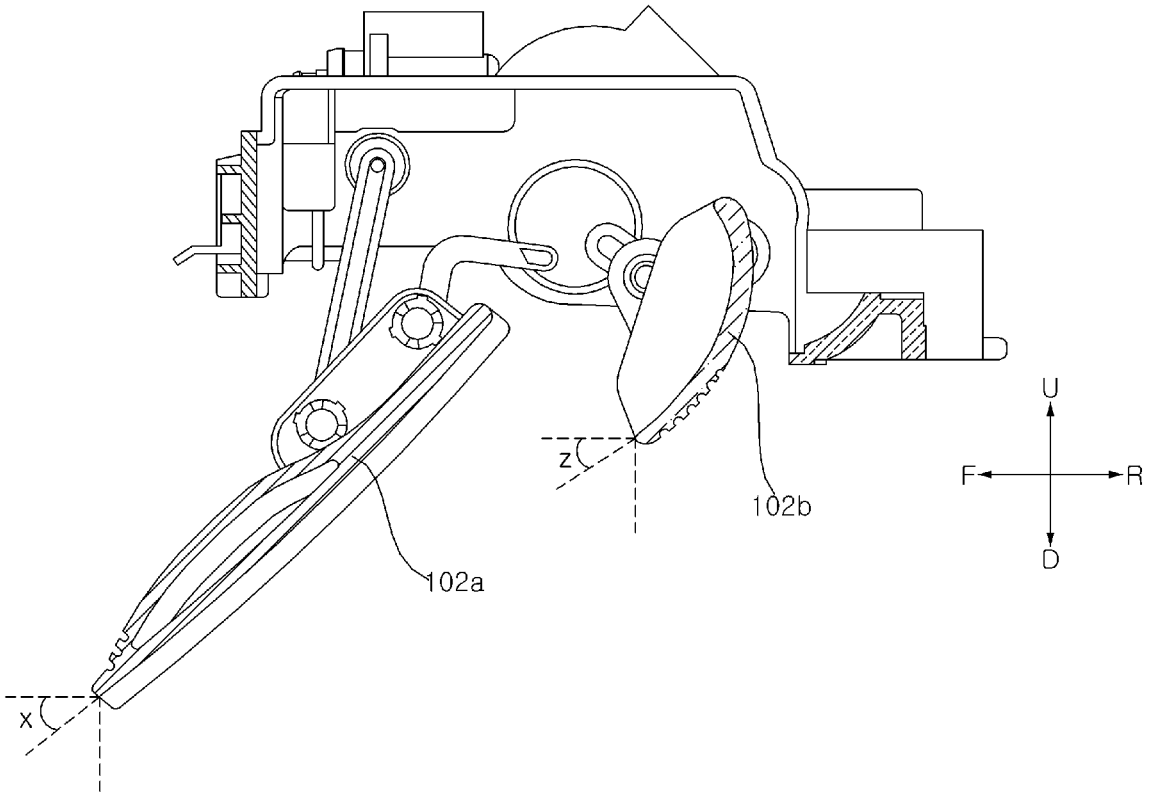
FIG. 13 is a cross-sectional side view of a vane module in a strong wind mode of an air conditioner according to an embodiment.

In addition, as shown in FIG. 13, the angle x at which the front end of the first vane 102*a* descends downward from the front may be approximately 45 degrees. In the second vane 102*b*, an angle z at which the extension line of the front end descends downward from the front may be approximately 45 degrees. Accordingly, the air discharged along the first vane 102*a* and the air discharged along the second vane 102*b* may be discharged in a substantially parallel direction. Accordingly, a wind speed of the discharged air may be increased.

Figure 14:
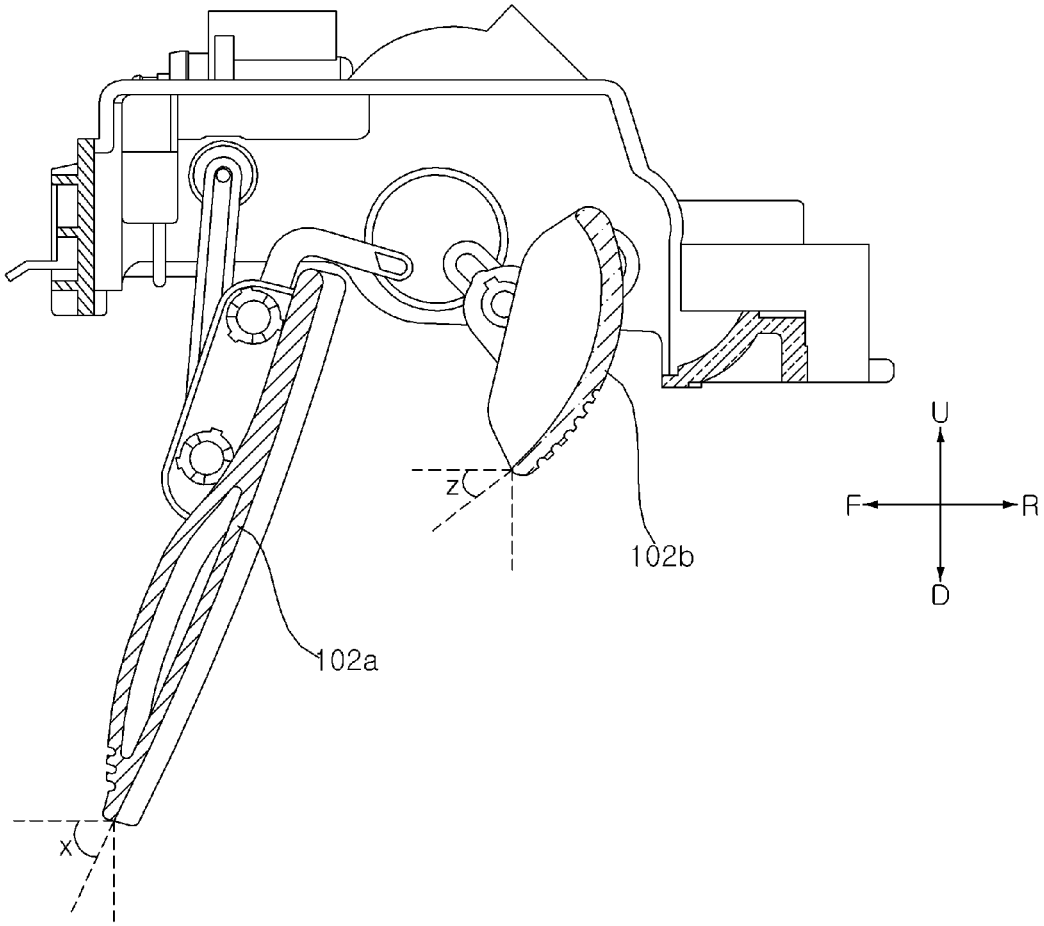
FIG. 14 is a cross-sectional side view of a vane module in a heating mode of an air conditioner according to an embodiment.

In addition, as shown in FIG. 14, the angle x at which the front end of the first vane 102*a* descends downward from the front may be approximately 80 degrees. In the second vane 102*b*, the angle z at which the extension line of the front end descends downward from the front may be approximately 50 degrees. Accordingly, the discharged air may be discharged in a direction close to a vertical direction in a substantially downward direction. The disposition of the first vane 102*a* and the second vane 102*b* may be utilized in a heating mode of the air conditioner 1.

The vane module 100 may include a vertical vane that is rotated in a direction horizontal to the discharge port 6 and guides air flowing through the discharge port 6. Rotation in a direction horizontal to the discharge port 6 may mean rotation in a leftward-rightward direction around a rotational axis formed in the upward-downward direction, for example, when the discharge port 6 has a shape having a length in the leftward-rightward direction, a width in the frontward-rearward direction, and a depth in the upward-downward direction (see FIG. 9).

The vertical vane 104 may be a plate-shaped vane disposed perpendicular to the discharge port 6. The vertical vane 104 may be a plate-shaped vane having a certain or predetermined area when viewed from the leftward-rightward direction. The vertical vane 104 may be a plate-shaped vane having a long side in the upward-downward direction, a short side in the frontward-rearward direction, and a thickness in the leftward-rightward direction. The vertical vane 104 may also be referred to as a third vane 104 for distinction from the first vane 102*a* and the second vane 102*b*.

Accordingly, an air discharge direction may be adjusted not only in a direction perpendicular to the discharge port 6, but also in a direction horizontal to the discharge port 6, so that the blowing direction may be precisely controlled.

The vertical vanes 104 may be divided into a low panel 104*a*, a mid panel 104*b*, and an upper panel 104*c* according to their positions in the upward-downward direction. When viewed from the leftward-rightward direction, the low panel 104*a* may have a parallelogram shape inclined from a front to a rear. Front and rear ends of the low panel 104*a* may have a streamlined shape concave inwardly of the low panel 104*a*. A plurality of sawtooth-shaped protrusions may be formed at a lower end of the low panel 104*a* and extending downward. The plurality of sawtooth-shaped protrusions may reduce noise caused by air flow. An upper end of the low panel 104*a* may be continuously formed with a lower end of the mid panel 104*b*.

A rotating end portion 104*e* may be formed at a front end of the low panel 104*a*. The rotating end portion 104*e* may have a ring shape a central portion of which is open in the frontward-rearward direction. Alternatively, the rotating end portion 104*e* may have a shape in which a part or portion of a ring shape is cut off. A protrusion protruding from the housing 106 of the vane module 100 may be inserted into the central portion of the rotating end portion 104*e*, so that the third vane 104 may be rotatably fastened to the housing 106.

When viewed from the leftward-rightward direction, the mid panel 104*b* may have a rectangular shape with a rear end that protrudes rearward than a rear end of the low panel

104*a*. The mid panel 104*b* may be continuously formed upward from an upper end of the low panel 104*a*. A fixed end portion 104*d* may be formed at a front end of the mid panel 104*b*. The fixed end portion 104*d* may protrude forward from the front end of the mid panel 104*b*. A front end of the fixed end portion 104*d* may be connected to the bar link 114 (more specifically, second bar link 114) as one body, so that the bar link 114 and the third vane 104 may be connected as one body.

When viewed from the leftward-rightward direction, the upper panel 104*c* may have a trapezoidal shape with a rear end inclined toward the front side. The upper panel 104*c* may be continuously formed upward from the upper end of the mid panel 104*b*. The front end of the upper panel 104*c* may form a straight line with the front end of the mid panel 104*b*.

The vertical vane 104 may be disposed in the first discharge port 6*a*. That is, the vertical vane 104 may be disposed upstream of the second vane 102*b*. Accordingly, generation of vortices may be prevented by preventing heterogeneous vanes having shapes orthogonal to each other from being alternately disposed in the air flow direction, thereby improving the blowing performance of the air conditioner 1.

The vertical vane 104 may be disposed adjacent to the front housing 106*a*. The vane module 100 may include a second motor 1102 that provides a drive force to the vertical vane 104 and a connection portion that transmits the drive force of the second motor 1102 to the vertical vane 104.

In the second motor 1102, the drive shaft 110*b* may be disposed in the direction of the short side of the discharge port 6. That is, the second motor 1102 may be disposed so that the drive shaft 110*b* protrudes in the frontward-rearward direction. The drive shaft 110*b* of the second motor 1102 may be disposed from the motor case 110*a* toward the front housing 106*a*.

The second motor 1102 may be seated on the mounting portion 106*f* of the housing 106. The motor case 110*a* of the second motor 1102 may be, for example, bolted to and fixed to the housing 106. For example, the motor case 110*a* of the second motor 1102 may be fixed by, for example, bolting it to a bolt hole protruding from the mounting portion 106*f*.

The connection portion between the second motor 1102 and the vertical vane 104 may include a connector 112 and a bar link 114. The connector 112 may have one or a first end connected to the drive shaft 110*b* as one body so that the other or a second end may move circumferentially according to the operation of the motor 110. That is, the connector 112 may convert rotational motion of the drive shaft 110*b* into a circumferential motion to cause the bar link 114 to circumferentially move.

For example, the connector 112 may include a first connection portion 112*a*, a body portion 112*b*, and a second connection portion 112*c*. The first connection portion 112*a* may be connected to the drive shaft 110*b* as one body. The first connection portion 112*a* may have a truncated cone shape surrounding the drive shaft 110*b*. The body portion 112*b* may be formed to extend by a certain or predetermined distance from the first connection portion 112*a*. The body portion 112*b* may be a plate-shaped member. The second connection portion 112*c* may have a protruding shape formed at an end of the body portion 112*b*. The first connection portion 112*a* and the second connection portion 112*c* may protrude in one direction from the body portion 112*b* and may be formed as one body with the body portion 112*b*, respectively. The bar link 114 may be connected to the second connection portion 112*c* as one body. The body portion 112*b* may be disposed to face the front housing 106*a*, and the first connection portion 112*a* and the second connection portion 112*c* may protrude from the body portion 112*b* toward the front housing 106*a*.

By adjusting a certain or predetermined distance by which the body portion 112*b* extends from the first connection portion 112*a*, a radius of circumferential motion of the bar link 114 and the vertical vane 104 may be adjusted. The bar link 114 may be connected to the other end of the connector 112 as one body and may extend in one direction. That is, the bar link 114 may be connected to the second connection portion 112*c* as one body and extend in one direction. When the second motor 1102 is seated on the mounting portion 106*f* of the right end of the mounting portion 106*f* formed in both ends in the leftward-rightward direction of the vane module 100, the bar link 114 may extend from the second motor 1102 to the left along the long side (longitudinal direction) of the discharge port 6. The bar link 114 may extend parallel to the front housing 106*a*. The bar link 114 may be disposed closely to the front housing 106*a* side among the rear housing 106*b* and the front housing 106*a*.

The bar link 114 may be formed with a length corresponding to the second discharge port 6*b*. The bar link 114 may be formed with a length corresponding to a distance between the cover plates 106*e* disposed in both ends of the vane module 100 in the leftward-rightward direction. The bar link 114 may be disposed parallel to the second vane 102*b*. The bar link 114 may be disposed parallel to the first vane 102*a*.

The bar link 114 may be formed by connecting a first bar link 114*a* and a second bar link 114*b*. The first bar link 114*a* has one or a first end connected to the second connection portion of the connector as one body and the other or a second end connected to one end of the second bar link 114*b*. A first bar link hook 114*aa* may be formed in the other end of the first bar link 114*a*, and a groove corresponding to the first bar link hook 114*aa* may be formed in the one end of the second bar link 114*b*. The other end of the first bar link 114*a* and the one end of the second bar link 114*b* may be fitted through the first bar link hook 114*aa*. The first bar link 114*a* and the second bar link 114*b* may be disposed on a same line.

In this embodiment, unlike the first motor 1101, the second motor 1102 is described on the premise that it is disposed at either side of both ends of the vane module 100 in the leftward-rightward direction; however, embodiments are not limited thereto and the two second motors 1102 may be disposed, for example, at both ends in the leftward-rightward direction and may drive a single bar link 114 together.

The vertical vane 104 has a fixed end portion 104*d* and a rotating end portion 104*e* and may rotate according to the operation of the second motor 1102. The vertical vane 104 may be connected to the bar link 114 as one body through the fixed end portion 104*d*.

The vertical vane 104 may receive the drive force of the second motor 1102 through the fixed end portion 104*d* connected to the bar link 114 as one body. More specifically, the vertical vane 104 may receive the drive force converted into a circumferential motion by the connector 112 through the fixed end portion 104*d*.

The vertical vane 104 may be rotatably connected to one side wall, that is, the front housing 106*a*, of the vane module 100 through the rotating end portion 104*e*. The rotating end portion 104*e* may be a centripetal point for circumferential motion of the fixed end portion 104*d*. A distance between the rotating end portion 104*e* and the fixed end portion 104*d* may be the same as a spaced distance between the first connection portion 112*a* and the second connection portion 112*c* of the connector 112. A direction in which the rotating end portion 104*e* and the fixed end portion 104*d* are spaced apart may be a same as the direction in which the first connection portion 112*a* and the second connection portion 112*c* of the connector 112 are spaced apart. Accordingly, as the second motor 1102 operates, the fixed end portion 104*d* moves circumferentially around the rotating end portion 104*e*, so that the vertical vane 104 may be rotated.

A plurality of vertical vanes 104 may be formed along a longitudinal direction, that is, leftward-rightward direction, of the bar link 114. A plurality of vertical vanes 104 may be formed while being spaced apart from each other along the leftward-rightward direction. The distance between the vertical vanes 104 at both ends among the plurality of vertical vanes 104 may be approximately the same as the length L1 of the upstream portion of the first discharge port 6*a*.

Therefore, the connector 112 for converting the rotational force of the motor 110 into circumferential motion and the bar link 114 that transmits the circumferential motion of the connector 112 to the plurality of vertical vanes 104, respectively, are provided, so that a plurality of vertical vanes 104 rotating in a direction horizontal to the discharge port 6 may be operated by a single motor 110. Accordingly, it is possible to maximize space efficiency in a space inside of the air conditioner 1 which may be cramped. In addition, noise generation and manufacturing costs increase due to the plurality of motors 110 may be prevented.

A rotational angle of the second motor 1102 may be limited to a certain or predetermined range. The certain range may be determined in consideration of a possibility that a flow guide effect of the vertical vane 104 may deteriorate and flow resistance may increase when the rotational range of the vertical vane 104 is excessively widened. The rotational angle of the motor 110 may be limited so that the vertical vane 104 rotates in a range of −60 degrees to 60 degrees based on a virtual plane that is perpendicular to the front housing 106*a* and passes through the fixed end portion 104*d* and the rotating end portion 104*e*.

The stopper portion 106*ea* may surround the bar link 114 while being spaced apart by a certain or predetermined distance in the upward-downward direction from the bar link 114 so as to limit the upward-downward movement of the bar link 114 to a certain or predetermined range. In the circumferential motion of the bar link 114 transmitted from the connector 112, the stopper portion 106*ea* may perform the same function as limiting the rotational angle of the second motor 1102 within a certain or predetermined range, by limiting the upward-downward movement of the bar link 114 to a certain or predetermined range.

The stopper portion 106*ea*, for example, may refer to a periphery of an open portion as the left and right or lateral ends of the cover plate 106*e* are open so that the bar link 114 passes therethrough.

Therefore, in limiting the rotational range of the vertical vane 104 to an appropriate range, a separate stopper portion 106*ea* is provided to easily control the rotational angle of the motor 110, while excessive rotation of the vertical vane 104 due to malfunction of the motor 110 may be prevented.

As described above, the second discharge port 6*b* may be wider than the first discharge port 6*a* in a certain or predetermined direction. A spreader 108 may be disposed in the first discharge port 6*a*. The spreader 108 may be inclined toward an adjacent one end side among ends of the first discharge port 6*a* in a certain or predetermined direction. As described above, when the length L2 of the second discharge port 6*b* in the leftward-rightward direction is longer than the length of the first discharge port 6*a* in the leftward-rightward direction, the spreader 108 is formed inclined toward an adjacent one end side among both ends of the first discharge port 6*a* in the leftward-rightward direction. For example, the spreader 108 disposed at the left end of the first discharge port 6*a* may be inclined to the left, and the spreader 108 disposed in the right end of the first discharge port 6*a* may be inclined to the right.

Therefore, in the structure in which the downstream portion of the discharge port 6 is wider than the upstream portion, the spreader 108 is provided in the upstream of the discharge port 6 so that the air passing through the upstream portion of the discharge port 6 is evenly spread to the entire downstream portion of the discharge port 6. Thus, air is uniformly discharged from the entire discharge port 6, thereby improving the blowing performance of the air conditioner 1.

The spreader 108 may be disposed on the upper surface of the second vane 102*b*. At least one spreader 108 may be disposed at both ends of the second vane 102*b* in the leftward-rightward direction. Thus, the spreader 108 is disposed on the upper surface of the second vane 102*b* to be supported by the second vane 102*b*, thereby eliminating the need to provide a separate structure for disposing and supporting the spreader 108. Accordingly, blowing performance of the air conditioner 1 may be improved by reducing unnecessary flow resistance in the discharge port 6.

The spreader 108 may be a plate-shaped member formed vertically from the upper surface of the second vane 102*b*. Therefore, the surface forming the width of the spreader 108 is substantially parallel to the air flow direction, so that the spreader 108 spreads the air evenly toward the entire area of the second discharge port 6*b* while minimizing pressure loss due to resistance.

Hereinafter, referring to FIGS. 17 to 21, a detachable means of vane module 100 of an air conditioner according to an embodiment will be described.

The vane module 100 may be detachably fastened to the discharge port 6 of the cabinet 2. For example, the housing 106 of the vane module 100 allows the vane module 100 to be fastened to the discharge port 6 of the lower cabinet 2*a*. Accordingly, convenience in assembling and managing the air conditioner 1 may be improved by modularizing the plurality of vanes as one body and enabling the vane module 100 to be detachable from the cabinet 2.

Figure 16:
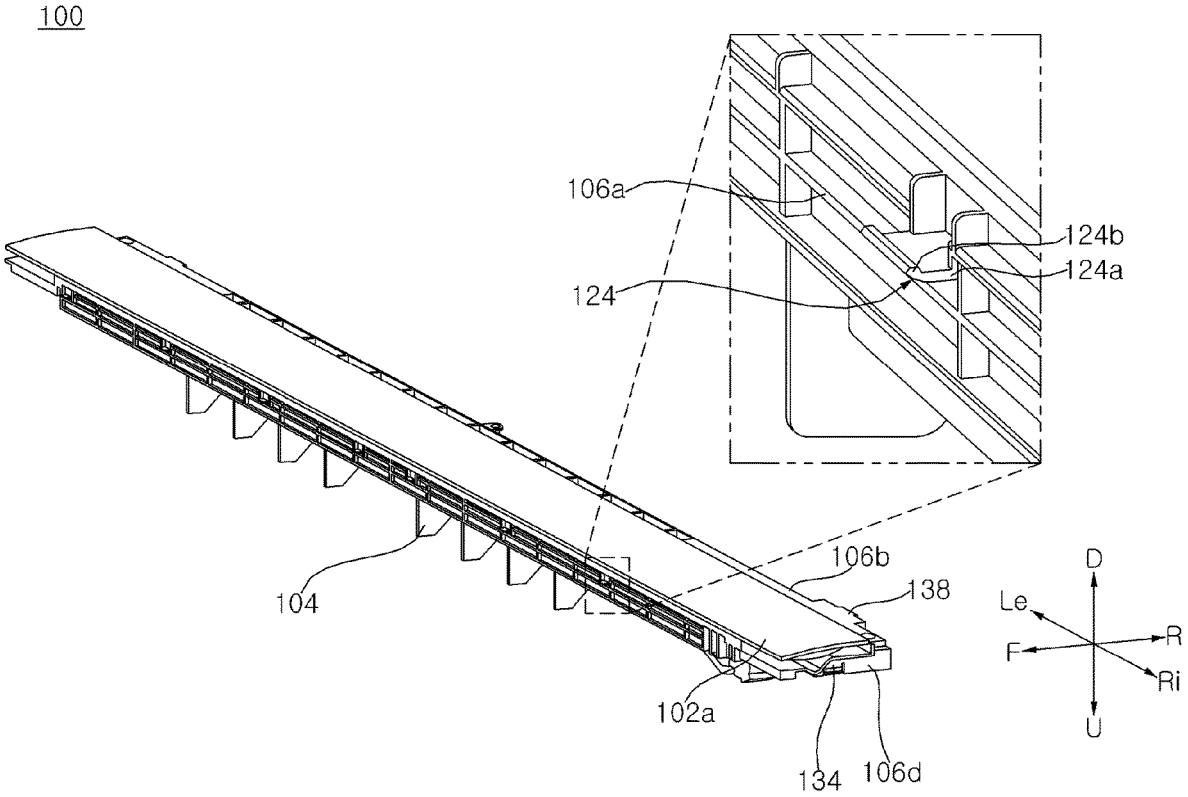
FIG. 16 is an enlarged front perspective view of a first hook of a vane module of an air conditioner according to an embodiment.

Referring to FIG. 16, the vane module 100 may further include a first hook 124 that protrudes forward from the front surface. The first hook 124 may protrude forward from the front housing 106*a*. The first hook 124 may protrude vertically from the front housing 106*a*. The first hook 124 may include a first hook head 124*b* that is obliquely bent downward from the front end and extends.

Figure 17:
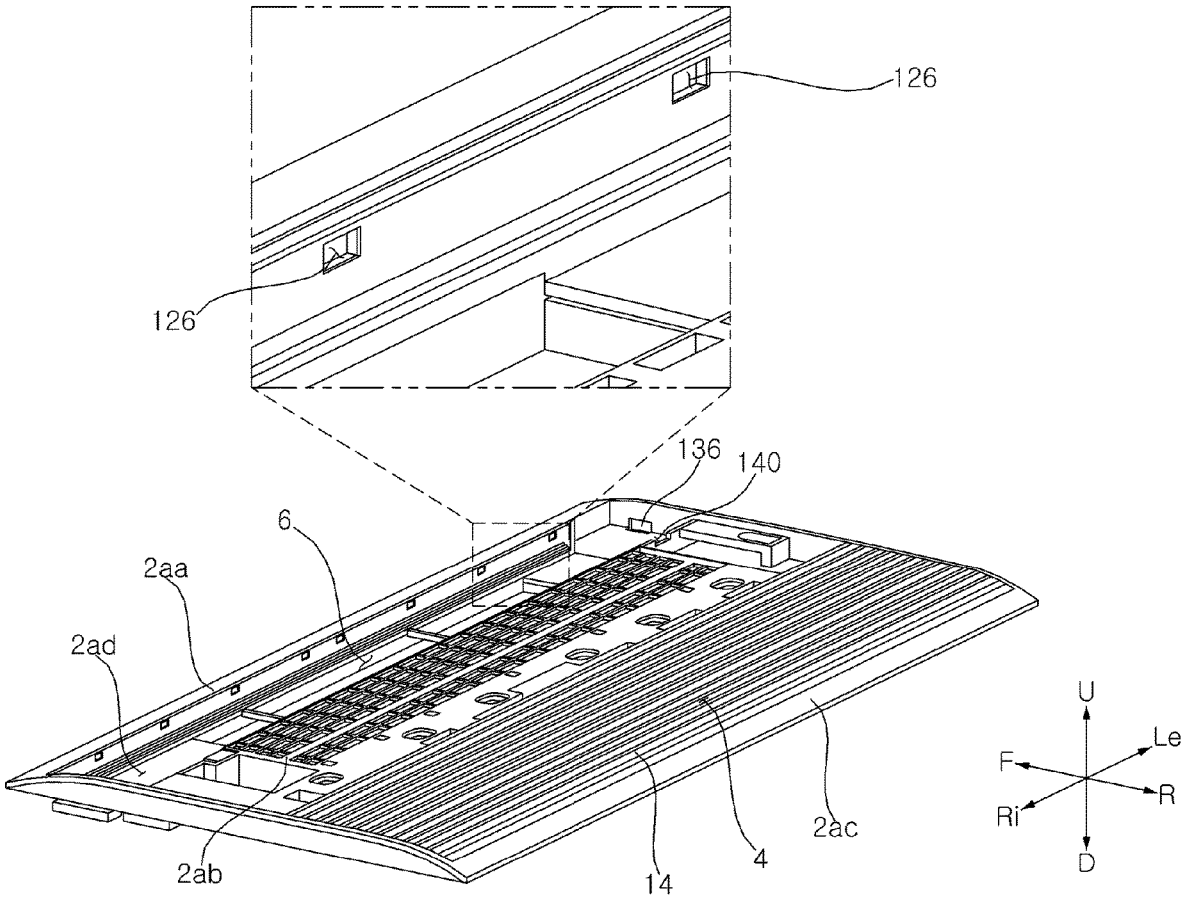
FIG. 17 is an enlarged perspective view of a first hook groove of a low cabinet of an air conditioner according to an embodiment.

Referring to FIG. 17, the cabinet 2 may include a first hook groove 126 that is recessed to allow the first hook 124 to be hooked therein. A first hook groove 126 is formed in a rear surface of a front portion 2*aa* of the lower cabinet 2*a* at a position corresponding to a position at which the first hook 124 formed in the front housing 106*a* of the vane module 100 is recessed. A shape of the first hook groove 126 may correspond to a shape of the first hook 124. The first hook 124 and the first hook groove 126 may be formed as a plurality along the longitudinal direction, that is, leftward-rightward direction, of the discharge port 6.

Figure 18:
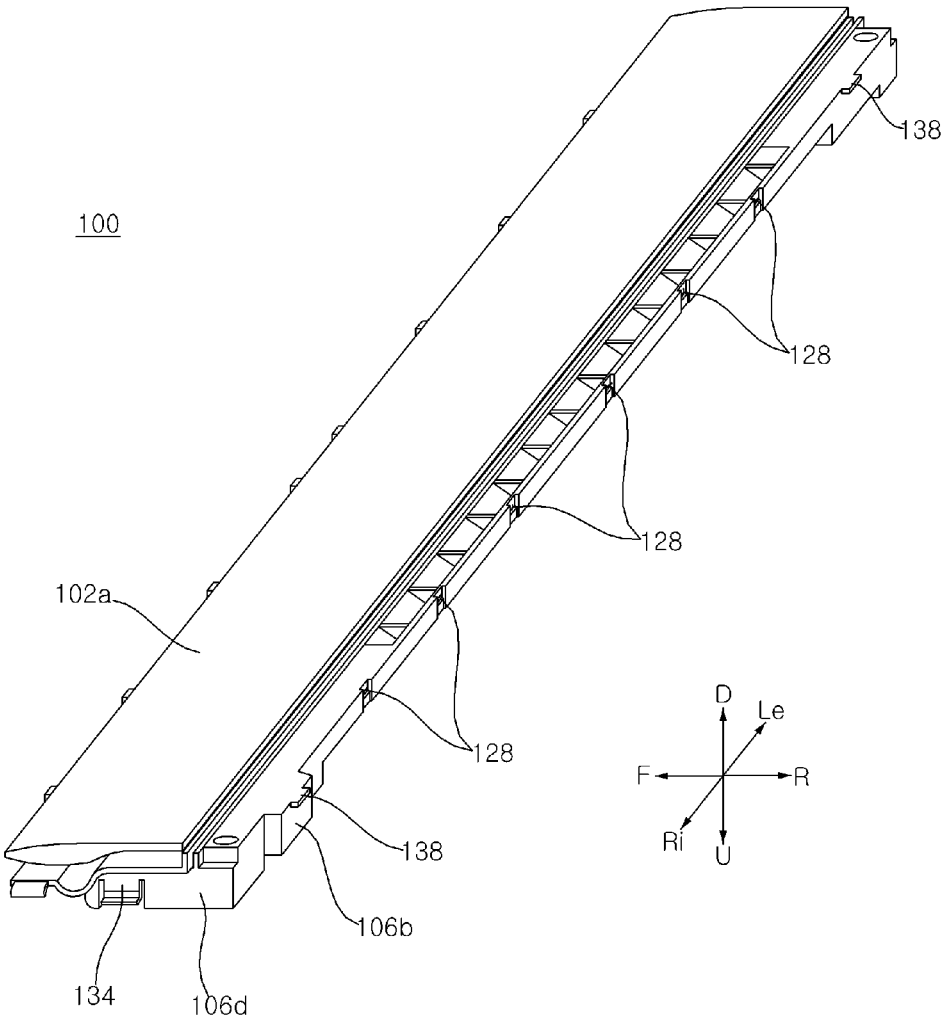
FIG. 18 is a bottom perspective view of a vane module of an air conditioner according to an embodiment.

Referring to FIG. 18, the vane module 100 may further include a second hook groove 128 recessed in a rear surface downward from an upper end. The second hook groove 128 may be formed by recessing an upper end of the rear housing 106*b* downward. A shape of the second hook groove 128 may correspond to a shape of the second hook 130.

Referring to FIG. 19, the cabinet 2 may further include a second hook 130 that protrudes downward to be hooked into the second hook groove 128. A second hook 130 that protrudes downward from the lower cabinet 2*a* may be formed in the front end of the middle portion 2*ab* of the lower cabinet 2*a*. A position at which the second hook 130 is formed may correspond to a position at which the second hook groove 128 is formed.

The second hook 130 may protrude in a direction different from the first hook 124, while being reflexively fastened to the second hook groove 128 in the process of fastening the first hook 124 to the first hook groove 126.

The second hook 130 may further include a second hook head 130*b* that is obliquely bent forward from a lower end and extends. The second hook 130 may be inclined forward.

In the rear of the low cabinet 2 adjacent to the portion at which the second hook 130 is formed, a retreat space 132 in which the second hook 130 may retreat rearward as the second hook head 130*b* is pushed rearward during fastening of the vane module 100 may be formed. The second hook 130 may temporarily retreat into the retreat space 132 in the process of fastening the vane module 100, and then may be hooked to the second hook groove 128 while being restored to an original position by elasticity.

A plurality of second hooks 130 and second hook grooves 128 may be formed along the longitudinal direction, that is, leftward-rightward direction, of the discharge port 6.

Therefore, in fastening the vane module 100 to the cabinet 2, when the front surface of the vane module 100 is lowered by tilting it upward with respect to the first hook groove 126 in order to insert the first hook 124 of the vane module 100 into the first hook groove 126 of the cabinet 2, the rear surface of the vane module 100 reflexively tilts downward with respect to the second hook 130 of the cabinet 2 and rises so that the second hook groove 128 and the second hook 130 of the vane module 100 are fastened, thereby improving fastening convenience of the vane module 100.

Herein, it is described that the first hook 124 and the second hook groove 128 are formed on front and rear surfaces of the vane module 100 respectively; however, embodiments are not limited thereto. That is, the first hook 124 and the second hook groove 128 may be formed on any surface to the extent that they are disposed on opposite sides of each other.

Figure 20:
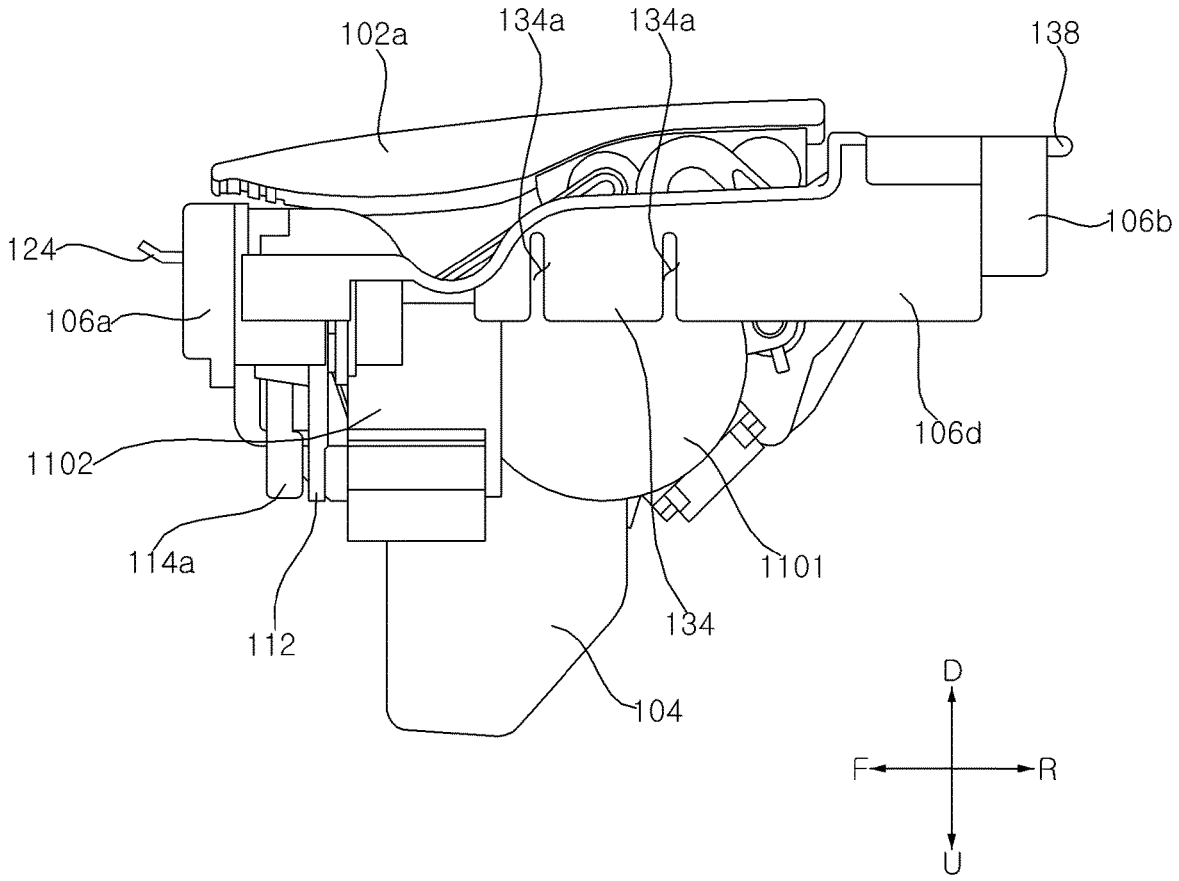
FIG. 20 is a right side view of a vane module of an air conditioner according to an embodiment.

Referring to FIG. 20, the vane module 100 may further include a third hook 134 formed by cutting a side surface downward from an upper end. In the vane module 100, the right side surface housing 106*d* may be cut downward from an upper end to form the third hook 134. In both ends of the third hook 134 in the frontward-rearward direction, a cutout 134*a* formed by cutting the right side surface housing 106*d* may be located.

Referring to FIG. 21, the cabinet 2 may further include a third hook groove 136 that is recessed to hook the third hook 134 therein. A third hook groove 136 formed by being recessed so that the third hook 134 may be hooked may be formed in a portion where the seating space 2*ae* of the mounting portion 106*f* is formed in the discharge port 6 of the low cabinet 2. A shape of the third hook groove 136 may correspond to a shape of the third hook 134. At least one third hook 134 may be formed on each of the left and right or lateral side surfaces of the vane module 100. Therefore, by cutting the outer surface of the vane module 100 to form the third hook 134, a fastening means of the vane module 100 may be manufactured relatively economically and simply.

Referring to FIG. 18, the vane module 100 may further include a fastening guide portion 138 a part or portion of a lower end of a rear surface of which that protrudes rearward and guides fastening of the vane module 100. In the vane module 100, a part or portion of a lower end of the rear housing 106*b* may protrude rearward to form the fastening guide portion 138.

Referring to FIG. 19, the cabinet 2 may further include a fastening guide groove 140 formed by being recessed so that the fastening guide portion 138 is seated therein. A portion corresponding to the fastening guide portion 138 among the front end portion of the middle portion 2*ab* of the low cabinet 2 may be recessed to form the fastening guide groove 140. A shape of the fastening guide groove 140 may correspond to a shape of the fastening guide portion 138.

At least two fastening guide portions 138 may be formed to be spaced apart from each other. Therefore, convenience in fastening the vane module 100 may be improved by allowing the fastening guide portion 138 to guide the fastening position of the vane module 100 in the process of adjusting a fastening position to a correct position.

Herein, it is described that the third hook 134 and the fastening guide portion 138 are formed on the side and rear surfaces respectively; however, embodiments are not limited thereto. That is, the third hook 134 and the fastening guide portion 138 may be formed on any surface of the vane module 100.

In addition to the detachable means for the above described vane module 100, the vane module 100 and the cabinet 2 may have a bolt hole corresponding to each other so as to be fastened with a bolt, for example.

In the air conditioner according to embodiments disclosed herein, the horizontal vane and the vertical vane adjust the wind direction of discharged air in directions orthogonal to each other respectively, thereby precisely adjusting the blowing direction. Further, the air conditioner according to embodiments disclosed herein is provided with double horizontal vanes that rotate in a direction perpendicular to the discharge port, so that the blowing direction may be more precisely controlled than when a single horizontal vane is provided.

The air conditioner according to embodiments disclosed herein may improve blowing performance, by preventing generation of vortexes by preventing different types of vanes from being alternately disposed in the air flow direction. Also, the air conditioner according to embodiments disclosed herein has a connector that converts the rotational force of the motor into circumferential motion and a bar link that transmits the circumferential motion of the connector to a plurality of vertical vanes, respectively, thereby reducing noise and cost due to a motor and improving space efficiency by operating a plurality of vertical vanes with a single motor.

In the air conditioner according to embodiments disclosed herein, in limiting the rotational range of the vertical vane to an appropriate range, a separate stopper portion is provided to easily control the rotational angle of the motor, while excessive rotation of the vertical vane due to malfunction of the motor may be prevented. The air conditioner according to embodiments disclosed herein may improve assembly and management convenience, by modularizing a plurality of vanes as one body and allowing the vane module to be detachable from the cabinet.

In the air conditioner according to embodiments disclosed herein, in fastening the vane module to the cabinet, when the front surface of the vane module is tilted upward with respect to the first hook groove and lowered in order to insert the first hook of the vane module into the first hook groove of the cabinet, the rear surface of the vane module is reflexively tilted downward with respect to the second hook of the cabinet and rises to fasten the second hook groove and the second hook of the vane module together, thereby improving fastening convenience of the vane module.

The air conditioner according to embodiments disclosed herein may form a third hook by cutting the outer surface of the vane module, thereby manufacturing the fastening means of the vane module relatively economically and simply. Also, the air conditioner according to embodiments disclosed herein may allow the fastening guide portion to guide the fastening position of the vane module in the process of adjusting the fastening position of the vane module to a correct position, thereby improving the fastening convenience of the vane module.

In the air conditioner according to embodiments disclosed herein, in structure in which the downstream portion of the discharge port is wider than the upstream portion, a spreader is provided at the upstream portion of the discharge port so that the air passing through the upstream portion of the discharge port is evenly spread throughout the downstream portion of the discharge port, and air is uniformly discharged from the entire discharge port, thereby improving blowing performance. The air conditioner according to embodiments disclosed herein disposes the spreader on the upper surface of the second vane to be supported by the second vane, so that there is no need to provide a separate structure for disposing and supporting the spreader, thereby improving the blowing performance of the air conditioner by reducing unnecessary flow resistance in the discharge port.

Embodiments disclosed herein have been made in view of the above problems, and may provide an air conditioner capable of increasing air volume of discharged air.

Embodiments disclosed herein may further provide an air conditioner capable of precisely adjusting the wind direction of discharged air. Embodiments disclosed herein may furthermore provide an air conditioner capable of uniformly blowing air over the entire surface of a discharge port even when the area of the discharge port is widened.

Embodiments disclosed herein provide an air conditioner capable of driving a plurality of vanes with a single motor. Embodiments disclosed herein also provide an air conditioner in which assembly and management convenience is not deteriorated even when a plurality of vanes are provided in a discharge port. Embodiments disclosed herein provide an air conditioner equipped with vane fastening means that can be manufactured simply.

An air conditioner according to embodiments disclose herein may include a cabinet in which a suction port and a discharge port are respectively formed; a fan which is disposed inside of the cabinet and blows air from the suction port to the discharge port; a heat exchanger which is disposed inside of the cabinet and exchanges heat with flowing air; and a vane module having a horizontal vane that is rotated in a direction perpendicular to the discharge port and guides air flowing through the discharge port, and a vertical vane that is rotated in a direction horizontal to the discharge port and guides air flowing through the discharge port. Therefore, the horizontal vane and the vertical vane adjust the wind direction of the discharge air in directions orthogonal to each other, thereby precisely controlling the blowing direction of the air conditioner.

The horizontal vane of the air conditioner according to embodiments disclosed herein may include a first vane disposed in or at a lower end portion of the discharge port; and a second vane disposed upstream of the first vane. Therefore, as a double vane rotating in a direction perpendicular to the discharge port is provided, it is possible to more precisely control the blowing direction compared to the case of having a single vane.

The vertical vane of the air conditioner according to embodiments disclosed herein disposed upstream of the second vane. Thus, it is possible to improve blowing performance, by preventing generation of vortexes by preventing different types of vanes orthogonal to each other from being alternately disposed in the air flow direction.

The vane module of the air conditioner according to embodiments disclosed herein may include a motor which has a drive shaft that protrudes in one direction; a connector one or a first end of which is connected to the drive shaft as one body and the other or a second end of which circumferentially moves according to an operation of the motor; and a bar link that is connected to the other end of the connector and extends in one direction. The vertical vane may have a fixed end portion which is connected to the bar link as one body and a rotating end portion which is rotatably connected to one side wall of the vane module, and rotates according to the operation of the motor. In addition, a plurality of vertical vane may be formed along a longitudinal direction of the bar link.

The air conditioner according to embodiments disclosed herein may have a connector that converts the rotational force of the motor into circumferential motion and a bar link that transmits the circumferential motion of the connector to a plurality of vertical vanes, respectively, thereby reducing noise and cost due to a motor and improving space efficiency by operating a plurality of vertical vanes with a single motor.

For example, the connector may include a first connection portion that is connected to the drive shaft as one body; a body portion that extends by a certain or predetermined distance from the first connection portion; and a second connection portion that is formed in an end of the body portion and connected to the bar link as one body.

The motor of the air conditioner according to embodiments disclosed herein may have a rotational angle limited to a certain or predetermined range. In addition, the vane module further include a stopper portion that surrounds the bar link while being spaced apart from the bar link by a certain or predetermined distance in an upward-downward direction so as to limit an upward-downward movement of the bar link to a certain or predetermined range. In limiting the rotational range of the vertical vane to an appropriate range, a separate stopper portion may be provided to easily control the rotational angle of the motor, while excessive rotation of the vertical vane due to malfunction of the motor may be prevented.

The vane module of the air conditioner according to embodiments disclosed herein may be detachably fastened to the discharge port of the cabinet. Thus, it is possible to improve assembly and management convenience, by modularizing a plurality of vanes as one body and allowing the vane module to be detachable from the cabinet.

The vane module of the air conditioner according to embodiments disclosed herein may further include a first hook formed by protruding forward from a front surface. The cabinet may further include a first hook groove formed by being recessed so that the first hook is hooked thereto. The first hook may include a first hook head which is bent obliquely downward from a front end and extended. In addition, the vane module may further include a second hook groove formed by recessing a rear surface of the vane module downward from an upper end, and the cabinet may further include a second hook protruding downward to be hooked into the second hook groove.

Thus, in fastening the vane module to the cabinet, when the front surface of the vane module is tilted upward with respect to the first hook groove and lowered in order to insert the first hook of the vane module into the first hook groove of the cabinet, the rear surface of the vane module may be reflexively tilted downward with respect to the second hook of the cabinet and rise to fasten the second hook groove and the second hook of the vane module together, thereby improving fastening convenience of the vane module.

The vane module of the air conditioner according to embodiments disclosed herein may further include a third hook formed by cutting a side surface from an upper end to a lower side, and the cabinet may further include a third hook groove formed by being recessed so that the third hook is hooked therein. Thus, a third hook is formed by cutting the outer surface of the vane module, thereby manufacturing the fastening means of the vane module relatively economically and simply.

The vane module of the air conditioner according to embodiments disclosed herein may further include a fastening guide portion a part or portion of a lower end of a rear surface of which that protrudes rearward and guides a fastening of the vane module. The cabinet may further include a fastening guide groove formed by being recessed so that the fastening guide portion is seated therein. Thus, it is possible to allow the fastening guide portion to guide the fastening position of the vane module in the process of adjusting the fastening position of the vane module to a correct position, thereby improving fastening convenience of the vane module.

The discharge port of the air conditioner according to embodiments disclosed herein may include a first discharge port in which the second vane is disposed; and a second discharge port which is formed downstream of the first discharge port and formed wider than the first discharge port in a certain or predetermined direction, and in which the first vane is disposed, and may further include a spreader that is disposed in the first discharge port and inclined to adjacent one end side among both ends of the first discharge port in a certain direction. Thus, in the structure in which the downstream portion of the discharge port is wider than the upstream portion, a spreader is provided at the upstream portion of the discharge port so that the air passing through the upstream portion of the discharge port is evenly spread throughout the downstream portion of the discharge port, and air is uniformly discharged from the entire discharge port, thereby improving blowing performance.

The spreader of the air conditioner according to embodiments disclosed herein may be disposed on an upper surface of the second vane. In addition, the spreader may be a plate-shaped member formed vertically from an upper surface of the second vane. Thus, the spreader is disposed on the upper surface of the second vane to be supported by the second vane, so that there is no need to provide a separate structure for disposing and supporting the spreader, thereby improving the blowing performance of the air conditioner by reducing unnecessary flow resistance in the discharge port.

As the accompanying drawings are merely for easily understanding embodiments disclosed herein, it should be understood that the technical spirit disclosed herein is not limited by the accompanying drawings, and all changes, equivalents or substitutions are included in the spirit and technical scope.

Although embodiments have been described with reference to specific embodiments shown in the drawings, it is apparent to those skilled in the art that embodiments are not limited to those exemplary embodiments and may be embodied in many forms without departing from the scope, which is described in the following claims. These modifications should not be individually understood from the technical spirit or scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a cabinet in which a suction port and a discharge port are respectively formed;

a fan that is disposed inside of the cabinet and blows air from the suction port to the discharge port;

a heat exchanger that is disposed inside of the cabinet and exchanges heat with flowing air; and a vane module having at least one horizontal vane that is rotated in a direction perpendicular to a direction in which the discharge port extends and guides air flowing through the discharge port, and at least one vertical vane that is rotated in a direction horizontal to the discharge port and guides air flowing through the discharge port, wherein the vane module is detachably fastened to the discharge port of the cabinet, wherein the vane module further comprises a first hook that protrudes forward from a front surface thereof, wherein the cabinet further comprises a first hook groove configured to receive the first hook hooked therein, wherein the first hook comprises a first hook head which is bent downward from a front end and extends therefrom, wherein the vane module further comprises a second hook groove formed by recessing a rear surface of the vane module downward from an upper end, and wherein the cabinet further comprises a second hook that protrudes downward to be hooked into the second hook groove.

2. The air conditioner of claim 1, wherein the at least one horizontal vane comprises:

a first vane disposed at a lower end portion of the discharge port; and a second vane disposed upstream of the first vane.

3. The air conditioner of claim 2, wherein the at least one vertical vane is disposed upstream of the second vane.

4. The air conditioner of claim 1, wherein the vane module further comprises:

at least one motor having a drive shaft that protrudes in a first direction;

a connector, a first end of which is connected to the drive shaft and a second end of which circumferentially moves according to an operation of the at least one motor; and a bar link that is connected to the second end of the connector and extends in a second direction, wherein each of the at least one vertical vane has a fixed end portion which is connected to the bar link and a rotating end portion which is rotatably connected to a side wall of the vane module, and rotates according to the operation of the motor.

5. The air conditioner of claim 4, wherein the at least one vertical vane comprises a plurality of vertical vane formed along a longitudinal direction of the bar link.

6. The air conditioner of claim 4, wherein the connector comprises:

a first connection portion that is connected to the drive shaft;

a body portion that extends by a predetermined distance from the first connection portion; and a second connection portion that is formed at an end of the body portion and connected to the bar link.

7. The air conditioner of claim 4, wherein the motor has a rotational angle limited to a predetermined range.

8. The air conditioner of claim 7, wherein the vane module further comprises a stopper portion that surrounds the bar link while being spaced apart from the bar link by a predetermined distance in an upward-downward direction so as to limit upward-downward movement of the bar link to a predetermined range.

9. The air conditioner of claim 1, wherein the vane module further comprises a third hook formed by cutting a side surface from an upper end to a lower side, and wherein the cabinet further comprises a third hook groove recessed to receive the third hook hooked therein.

10. An air conditioner, comprising:

a cabinet in which a suction port and a discharge port are respectively formed;

a fan that is disposed inside of the cabinet and blows air from the suction port to the discharge port;

a heat exchanger that is disposed inside of the cabinet and exchanges heat with flowing air; and a vane module having at least one horizontal vane that is rotated in a direction perpendicular to a direction in which the discharge port extends and guides air flowing through the discharge port, and at least one vertical vane that is rotated in a direction horizontal to the discharge port and guides air flowing through the discharge port, wherein the vane module is detachably fastened to the discharge port of the cabinet, and wherein the vane module further comprises a fastening guide, a portion of a lower end of a rear surface of which protrudes rearward and guides a fastening of the vane module, and wherein the cabinet further comprises a fastening guide groove recessed to receive the fastening guide portion seated therein.

11. An air conditioner, comprising:

a cabinet in which a suction port and a discharge flow path are respectively formed;

a fan that is disposed inside of the cabinet and blows air from the suction port to the discharge flow path;

a heat exchanger that is disposed inside of the cabinet and exchanges heat with flowing air;

a first vane that is rotated to guide air flowing through the discharge flow path; and a second vane that is disposed upstream of the first vane and rotated to guide air flowing through the discharge flow path, wherein the discharge flow path comprises:

a first discharge portion in which the second vane is disposed; and a second discharge portion that is formed downstream of the first discharge portion and wider than the first discharge portion in a predetermined direction, and in which the first vane is disposed, and wherein the air conditioner further comprises at least one spreader which is disposed in the first discharge portion and inclined to be adjacent one end side of ends of the first discharge portion in a predetermined direction, further comprising a fastening guide, a portion of a lower end of a rear surface of which protrudes rearward and guides a fastening of the first vane and the second vane, and wherein the cabinet further comprises a fastening guide groove recessed to receive the fastening guide portion seated therein.

12. The air conditioner of claim 11, wherein the at least one spreader is disposed at an upper surface of the second vane.

13. The air conditioner of claim 12, wherein the at least one spreader is disposed at both end portions of the second vane in a predetermined direction.

14. The air conditioner of claim 12, wherein the at least one spreader is a plate-shaped member formed vertically from an upper surface of the second vane.

15. An air conditioner, comprising:

a cabinet in which a suction port and a discharge are respectively formed;

a fan that is disposed inside of the cabinet and blows air from the suction port to the discharge;

a heat exchanger that is disposed inside of the cabinet and exchanges heat with flowing air; and a vane module having a plurality of horizontal vanes that is rotated about a horizontally extending axis and guides air flowing through the discharge, and a plurality of vertical vanes that is rotated about a vertically extending axis and guides air flowing through the discharge, wherein the plurality of horizontal vanes comprises:

a first vane disposed at a lower end portion of the discharge; and a second vane disposed upstream of the first vane, wherein the vane module is detachably fastened to the discharge of the cabinet, wherein the vane module further comprises a first hook that protrudes forward from a front surface thereof, wherein the cabinet further comprises a first hook groove configured to receive the first hook hooked therein, wherein the first hook comprises a first hook head which is bent downward from a front end and extends therefrom, wherein the vane module further comprises a second hook groove formed by recessing a rear surface of the vane module downward from an upper end, and wherein the cabinet further comprises a second hook that protrudes downward to be hooked into the second hook groove.

16. The air conditioner of claim 15, wherein the plurality of vertical vanes is disposed upstream of the second vane.

17. The air conditioner of claim 15, further comprising a first motor configured to rotate the plurality of horizontal vanes and a second motor configured to rotate the plurality of vertical vanes.

* * * * *